US009718579B2

(12) United States Patent
Pisano

(10) Patent No.: US 9,718,579 B2
(45) Date of Patent: Aug. 1, 2017

(54) METAL PALLET WITH ASSEMBLABLE COMPONENTS

(71) Applicant: Roberto Pisano, Treviso (IT)

(72) Inventor: Roberto Pisano, Treviso (IT)

( * ) Notice: Subject to any disclaimer, the term of this patent is extended or adjusted under 35 U.S.C. 154(b) by 0 days.

(21) Appl. No.: 14/913,359

(22) PCT Filed: Aug. 19, 2014

(86) PCT No.: PCT/IB2014/001562

§ 371 (c)(1),
(2) Date: Feb. 20, 2016

(87) PCT Pub. No.: WO2015/025210

PCT Pub. Date: Feb. 26, 2015

(65) Prior Publication Data

US 2016/0207663 A1 Jul. 21, 2016

(30) Foreign Application Priority Data

Aug. 23, 2013 (IT) ..... VE2013A0044

(51) Int. Cl.
*B65D 19/38* (2006.01)
*B65D 19/00* (2006.01)

(52) U.S. Cl.
CPC ..... *B65D 19/0095* (2013.01); *B65D 19/385* (2013.01); *B65D 2519/00024* (2013.01); *B65D 2519/00059* (2013.01); *B65D 2519/00094* (2013.01); *B65D 2519/0097* (2013.01); *B65D 2519/00129* (2013.01);
(Continued)

(58) Field of Classification Search
CPC ..... B65D 2519/00308; B65D 2519/00363; B65D 2519/00393; B65D 2519/00273; B65D 2519/00293; B65D 2519/00323; B65D 2519/00333; B65D 2519/00024; B65D 2519/00268; B65D 19/08
USPC ..... 108/51.11, 51.3, 57.18, 57.21, 57.22, 108/57.29, 57.3, 57.32, 57.19
See application file for complete search history.

(56) References Cited

U.S. PATENT DOCUMENTS 1,202,046 A * 10/1916 Freeze ..... F26B 25/18 108/57.32
1,359,138 A * 11/1920 Wine ..... 108/57.22
(Continued)

FOREIGN PATENT DOCUMENTS

EP 0006366 1/1980

*Primary Examiner* — Jose V Chen
(74) *Attorney, Agent, or Firm* — Themis Law

(57) ABSTRACT

An assemblable metal pallet having two plinths each provided with a cut-out and with a loading platform and a plurality of components obtained from a single piece of a basic metal profile having a symmetrical shape about the longitudinal central plane and provided with a longitudinal rib of rectangular cross-section and constant height extending from one and the same part with respect to a base plane, and with two outer lateral webs having their edge bent inwards and at least partly coplanar with the top of the rib, the components including a first component composed of a piece of basic profile bent to a C-shape with the aperture facing upwards, a second component composed of a piece of the same basic profile bent to an inverted U-shape, a further component formed from a piece of the same basic profile and constituting a crosspiece for connecting together the plinths.

37 Claims, 19 Drawing Sheets

(52) U.S. Cl.
CPC ..... *B65D 2519/00273* (2013.01); *B65D 2519/00293* (2013.01); *B65D 2519/00323* (2013.01); *B65D 2519/00333* (2013.01); *B65D 2519/00378* (2013.01); *B65D 2519/00402* (2013.01); *B65D 2519/00407* (2013.01); *B65D 2519/00412* (2013.01); *B65D 2519/00417* (2013.01); *B65D 2519/00567* (2013.01)

(56) References Cited

U.S. PATENT DOCUMENTS 1,803,416 A * 5/1931 Walp ..... B65D 19/0016 108/57.32
2,099,051 A * 11/1937 Clark ..... B65D 19/0038 108/57.3
2,455,197 A * 11/1948 Sullivan ..... B65D 19/0038 108/52.1
2,544,743 A * 3/1951 Vrabcak ..... B65D 19/0038 108/51.3
2,692,107 A * 10/1954 De Ridder ..... B65D 19/0095 108/57.17
2,928,638 A * 3/1960 Parker ..... B65D 19/0016 108/51.3
3,172,374 A * 3/1965 Allen ..... B65D 19/0051 108/52.1
3,438,164 A * 4/1969 Duepree ..... A47B 47/04 108/901
3,616,766 A * 11/1971 Weiss ..... B65D 19/0097 108/57.18
4,112,854 A * 9/1978 Pitchford ..... B65D 19/0095 108/56.1
4,145,976 A * 3/1979 Svirklys ..... B65D 19/0095 108/56.1
4,326,467 A * 4/1982 Schleicher ..... B65D 19/004 108/56.1
4,424,752 A * 1/1984 Aberg ..... B65D 19/004 108/57.3
4,485,744 A * 12/1984 Umemura ..... B65D 19/0095 108/57.18
5,211,117 A * 5/1993 Beamer ..... B65D 57/00 108/53.1
5,367,960 A * 11/1994 Schleicher ..... B65D 19/0095 108/56.1
5,417,167 A * 5/1995 Sadr ..... B65D 19/0093 108/57.19
5,507,236 A * 4/1996 Bruno ..... B65D 19/0028 108/51.11
6,938,557 B1 * 9/2005 Grigsby, Jr. ..... B65D 19/0095 108/51.11
7,677,183 B2 * 3/2010 Borggaard ..... B65D 19/0014 108/51.11
7,987,798 B2 * 8/2011 Kim ..... B65D 19/0095 108/51.11
9,415,896 B2 * 8/2016 Ng ..... B65D 19/0073
2003/0189153 A1 10/2003 Nakabayashi et al.

* cited by examiner

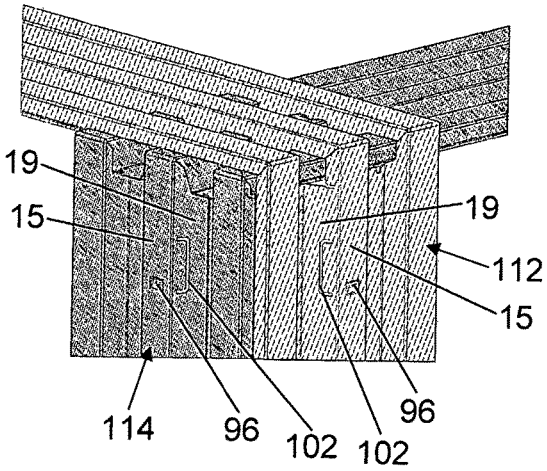
FIG. 45
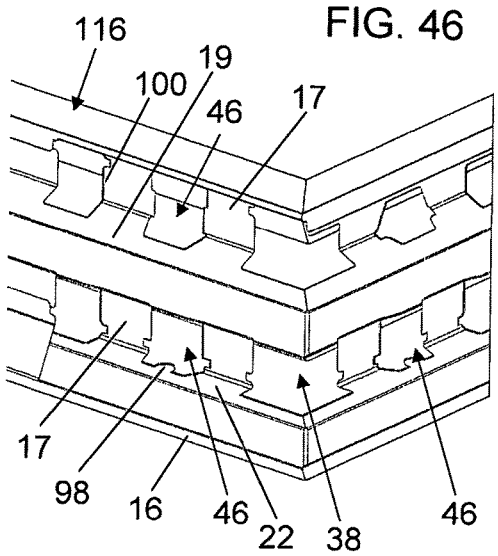
FIG. 46
FIG. 47
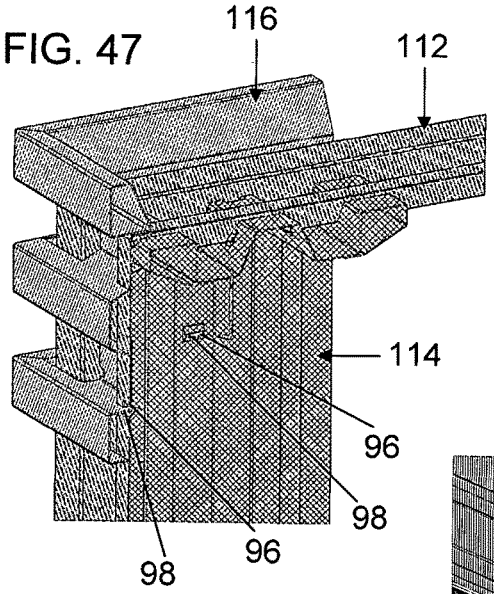
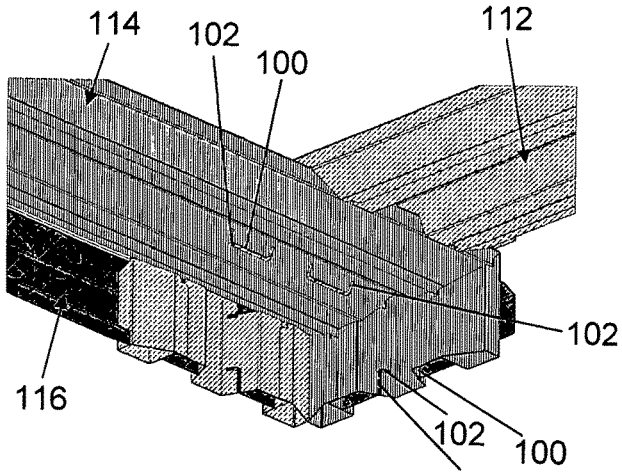
FIG. 48

METAL PALLET WITH ASSEMBLABLE COMPONENTS

The present invention relates to a metal pallet with assemblable components.

Metal pallets are known for goods storage and transport. They have been used for some time alongside traditional wooden pallets, and are indeed often preferred in various utilization sectors because of a series of characteristics such as price, construction by automated machines, conformity to international requirements, hygiene sterilization, recyclability, etc.

However, currently known metal pallets are not completely satisfactory either in terms of their ratio of weight to capacity, or because of their overall size. In particular this latter is a critical factor during unloaded pallet transport by the user, and precisely to obviate this drawback pallets have been proposed which can be assembled at the time of their initial use. Notwithstanding this, known assemblable pallets are still costly to construct as they are formed of components of different configuration, and are also particularly complicated to assemble as the fact that they have to be assembled at the time of use means that specific equipment is required.

Moreover known pallets, including assemblable pallets, generally have standard dimensions (800 mm×1200 mm, 1200 mm×1200 mm, etc. or 48 inches×48 inches for the American market), because of which the various manufacturers are able to produce pallets only of these dimensions and are unable to satisfy specific requirements of particular users preferring pallets of personalized dimensions.

US 2003/0189153 describes a pallet with plinths comprising cut-out holes and with a loading platform. In particular, some components, but not all, are made with a particular ridged profile, while others, such as the pallet reinforcement elements, are made with a different type of profile; this makes the construction of this type of pallet particularly laborious and costly.

An object of the invention is to provide a metal pallet which is composed of assemblable modular elements, is of optimal weight/capacity ratio and of considerable structural rigidity and stability.

Another object of the invention is to provide a pallet which is of small overall size when in its unassembled configuration.

Another object of the invention is to provide a pallet which is of considerable versatility in terms both of dimensions and shape.

Another object of the invention is to provide a pallet of simple and low-cost construction.

Another object of the invention is to provide a pallet which can be easily and quickly assembled by the user without the use of special equipment.

Another object of the invention is to provide a pallet which, besides forming a support base for goods in general, can also provide lateral containing for such goods, i.e. can form a so-called "cage".

All these and other objects which will be apparent from the ensuing description are attained, according to the invention, by an improved pallet in accordance with claim 1.

Some preferred embodiments of the present invention are further clarified hereinafter with reference to the accompanying drawings, in which:

FIG. 1 is a perspective view of a first embodiment of the pallet according to the invention in its assembled configuration, FIG. 2 shows it in exploded perspective view, FIG. 3 is a cross-section through a first embodiment of the profile from which all the components of the pallet according to the invention are obtained, FIG. 4 is a partial view in accordance with the longitudinal section IV-IV of FIG. 3 showing the detail of an aperture defined in the walls of the ribs and in the lateral bands of the profile itself, intended to facilitate the bending of the profile through 90° about a transverse axis, FIG. 5 is a perspective view of a first component of FIG. 1 seen from above, FIG. 6 is a perspective view of a second component of FIG. 1 seen from below, FIG. 7 is a perspective view of a third component of FIG. 1 seen from below, FIG. 8 is a perspective view of a fourth component of FIG. 1 seen from below, FIG. 9 is a perspective view from below showing an enlarged detail of the connection of the second component to the first, FIG. 10 is a perspective view from above showing another enlarged detail of the connection of the second component to the first, FIG. 11 is a perspective view from below showing an enlarged detail of the connection of the third component to the first and to the second component, FIG. 12 is a perspective view from below showing an enlarged detail of the connection of fourth components to the second component, FIG. 13 is an enlarged vertical section on the line XIII of FIG. 1 showing the node at which the first, second and third component are joined together, FIG. 14 is an enlarged vertical section on the line XIV of FIG. 1, FIG. 15 is an enlarged horizontal section on the line XV of FIG. 1, FIG. 16 shows in the same view as FIG. 3 a different base profile used to obtain all the components of the pallet according to the invention, FIG. 17 is a perspective view of a second embodiment of the pallet according to the invention in its assembled configuration, FIG. 18 shows it in exploded perspective view from above, FIG. 19 shows it in perspective view from below a first variant of the pallet of FIG. 17, FIG. 20 shows it in perspective view a second variant of the pallet of FIG. 17, FIG. 21 shows it in perspective view from above a detail of a first component of the pallet of FIG. 17, FIG. 22 shows it in perspective view from below a detail of a second component of the pallet of FIG. 17, FIG. 23 is a perspective view from above showing in vertical section an enlarged detail of the connection of the second component of FIG. 22 to the first component of FIG. 21, FIG. 24 is a perspective view from above showing a different detail of the component of FIG. 22, FIG. 25 is a perspective view from above showing in partial horizontal section a second enlarged detail of the connection of the second component of FIG. 22 to the first component of FIG. 21, FIG. 26 is a perspective view from above showing in partial vertical section a third enlarged detail of the connection of the second component of FIG. 22 to the first component of FIG. 21, FIG. 27 is a perspective view from above showing a detail of a third component of the pallet of FIG. 17, FIG. 28 is a perspective view from above showing in partial vertical section a first enlarged detail of the connection of the third component of FIG. 27 to the first component of FIG. 21, FIG. 29 is a perspective view from above showing in a different vertical section a second enlarged detail of the connection of the third component of FIG. 27 to the first component of FIG. 21, FIG. 30 is a perspective view from above showing the connection of the second component of FIG. 22 to the first component of FIG. 21, FIG. 31 is a perspective view from below showing a detail of the third component of FIG. 27, FIG. 32 is a perspective view from above showing in vertical section a detail of the node at which the first component of FIG. 21, the second component of FIG. 22 and third component of FIG. 27 are joined together, FIG. 33 is a perspective view from above showing in a different vertical section a second detail of the node at which the first component of FIG. 21, the second component of FIG. 22 and third component of FIG. 27 are joined together, FIG. 34 is a perspective view of a variant of the pallet of FIG. 17 in which an overlying cage containment structure is provided, FIG. 35 is an exploded perspective view of the cage containment structure of FIG. 34, FIG. 36 shows the first component, that of FIG. 21, in a different perspective view from above, FIG. 37 is a perspective view from above showing an enlarged detail of a fifth component of the structure of FIG. 34, FIG. 38 is a perspective view from above showing in horizontal section an enlarged detail of the connection between the fifth component of FIG. 37 and the first component of FIG. 36, FIG. 39 is a perspective view from above showing a detail of a sixth component of the structure of FIG. 34, FIG. 40 is a perspective view from above showing in horizontal section an enlarged detail of the connection between the sixth component of FIG. 39 and the third component of FIG. 27, FIG. 41 is a perspective view showing another detail of a sixth component of FIG. 39, FIG. 42 is a perspective view showing another detail of the fifth component of FIG. 37, FIG. 43 is a perspective view from above showing in vertical section an enlarged detail of the connection between the fifth component of FIG. 41 and the sixth component of FIG. 42, FIG. 44 is a perspective view from below showing in a different vertical section an enlarged detail of the connection between the fifth component of FIG. 41 and the sixth component of FIG. 42, FIG. 45 shows the connection between the fifth component of FIG. 41 and the sixth component of FIG. 42 in a different perspective view from above, FIG. 46 is a perspective view from above showing a detail of a seventh component of FIG. 34, FIG. 47 is a perspective view from above showing in vertical section a first detail of the node at which the seventh component of FIG. 46, and the components of FIG. 45 are joined together, FIG. 48 is a different perspective view showing in vertical section a second detail of the node at which the seventh component of FIG. 46, and the components of FIG. 45 are joined together, FIG. 49 is a perspective view showing a first embodiment of a packaging plinth.

As can be seen from the figures, the pallet according to the invention comprises, in the embodiment shown in FIGS. 1-15, four different types of modular components 4, 6, 8, 10, obtained from pieces of a single type of basic ribbed profile 2 intended to be bent and assembled together in a simple and quick manner, preferably by the user at the time of initial utilization of the pallet.

Figure 1:
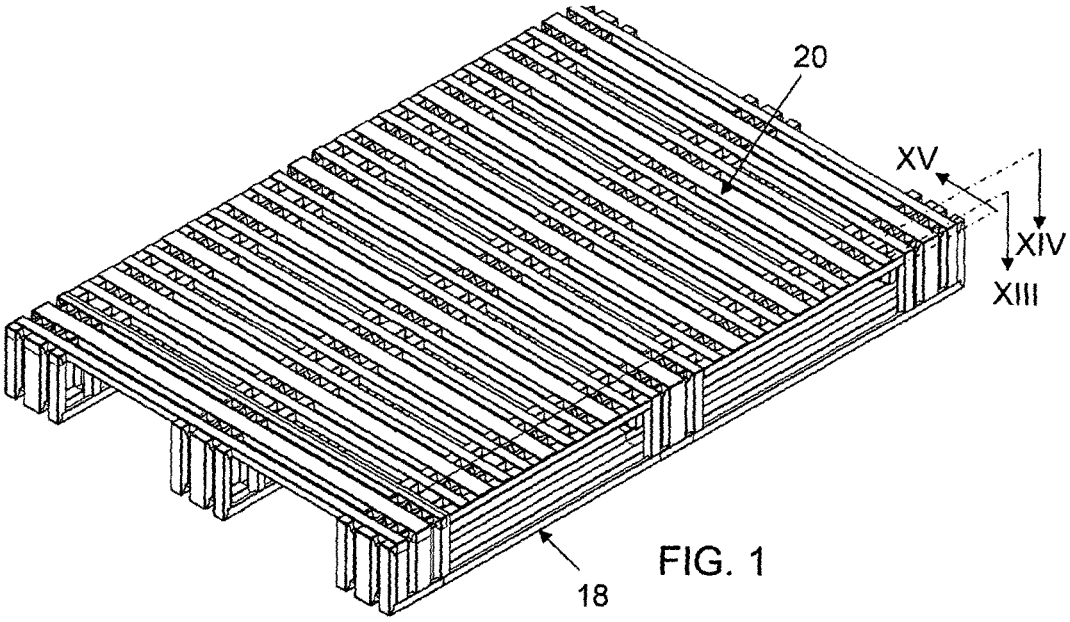
Figure 2:
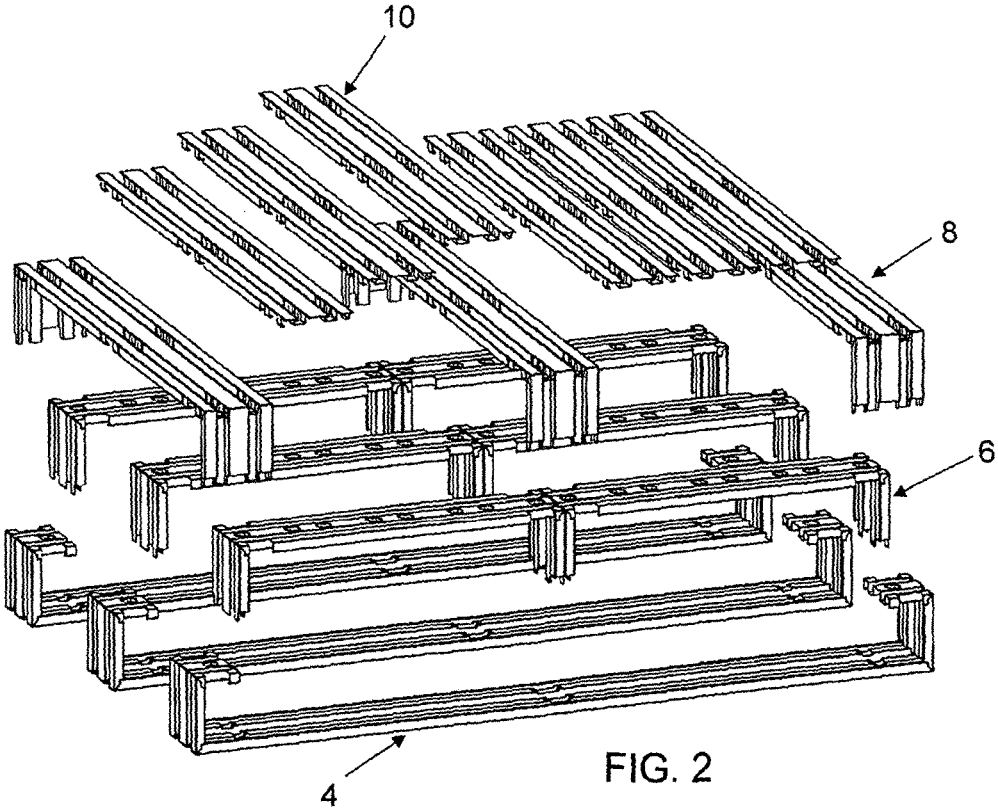
Figure 3:
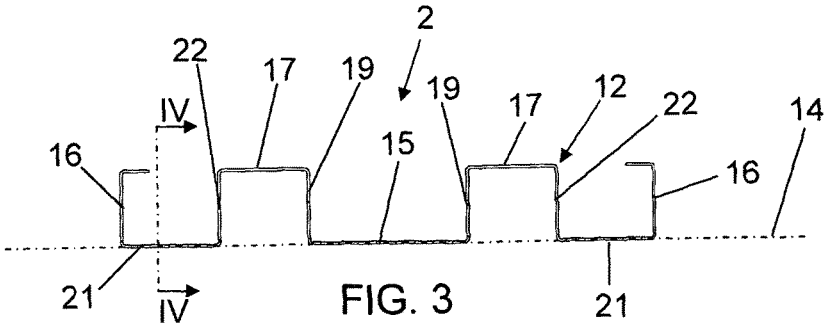

This ribbed profile 2, common to all four pallet components 4, 6, 8, 10 and illustrated in a first embodiment in FIG. 3, is obtained starting from a flat strip of sheet metal having the desired thickness, preferably between 0.4 and 0.6 mm. It has a shape symmetrical about the central longitudinal plane, and defines at least one but preferably two longitudinal ribs 12 of rectangular cross-section extending from a base plane 14 of the profile, and two outer lateral webs 16 which also extend perpendicular from the base plane 14 and have their edges bent at their top towards the interior of the profile, complementarily to the top 17 of the rectangular ribs 12.

In greater detail, the base plane 14 of the ribbed profile 2 comprises a central longitudinal band 15 interposed between the inner vertical walls 19 of the ribs 12, and two lateral bands 21, each of which is bounded by the other outer vertical wall 22 of the corresponding rib 12 and by the outer lateral web 16.

For descriptive clarity the terms used to define the various parts of the different components forming the pallet according to the invention will now be described.

Figure 5:
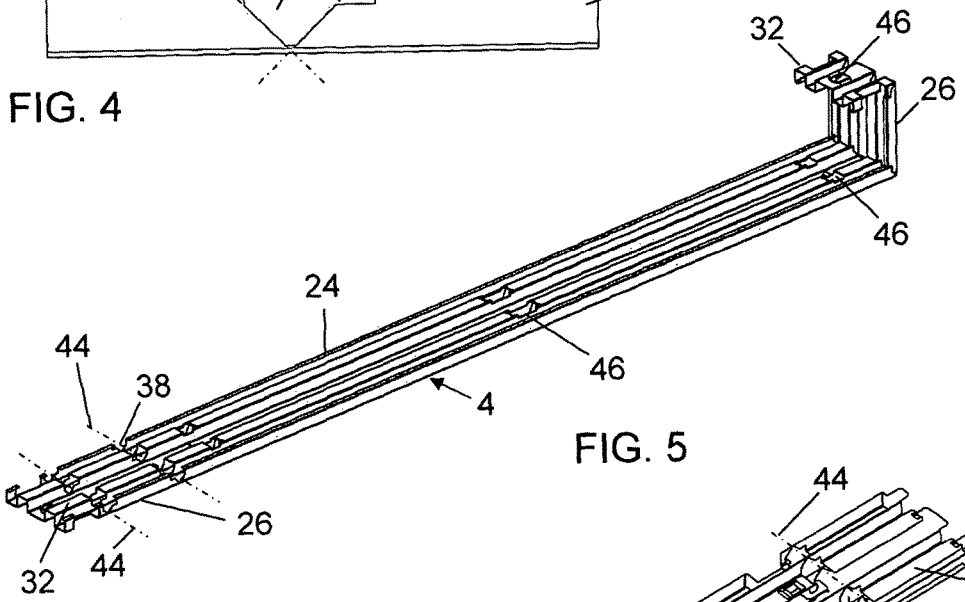

The component 4 is defined of C-shape and is shown in FIG. 5 in its semi-bent condition, more precisely with its right end already bent to give the element its C-shape, and with its left end ready for bending but not yet bent. Relative to this, the central portion means the portion facing the aperture of the C, the lateral portion means each one of the two portions adjacent to the central portion and disposed perpendicular thereto, and the terminal portion means each portion adjacent to the lateral portion and disposed parallel to the central portion.

Figure 6:
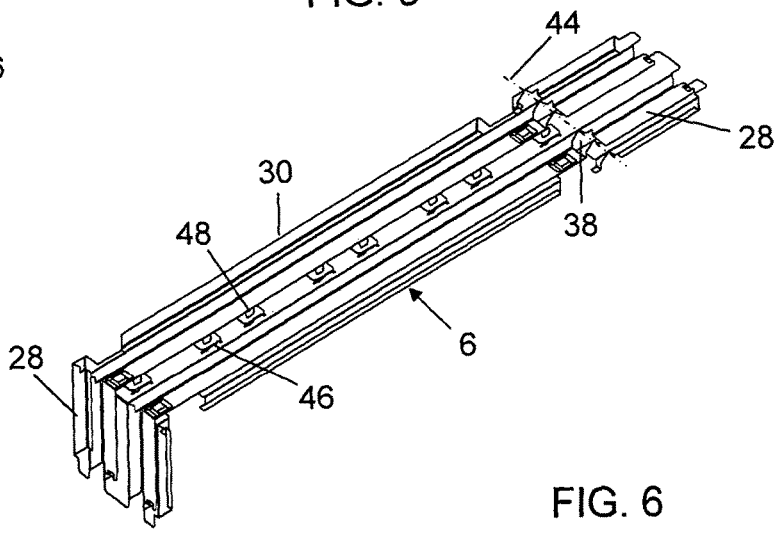
Figure 7:
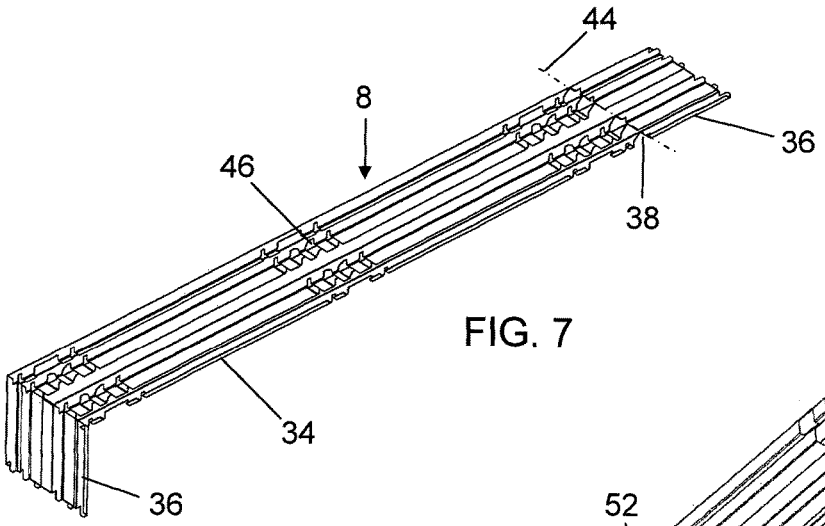
Figure 8:
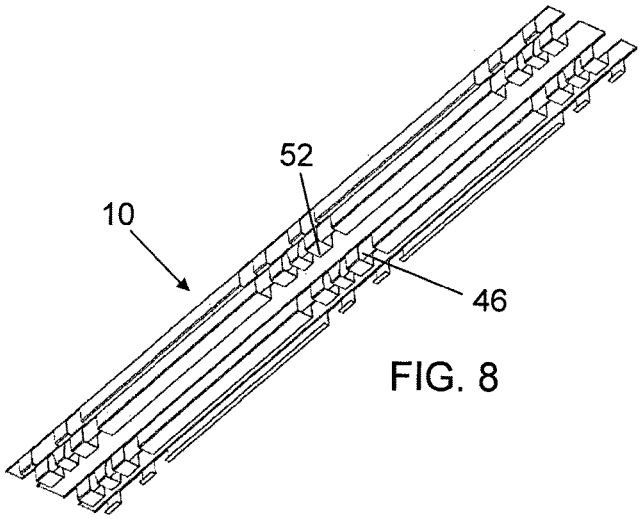

The components 6 and 8 are defined as of inverted U-shape and are shown in FIGS. 6 and 7 in their semi-bent condition, i.e. with the left end already bent and the right end ready for bending but not yet bent. Relative to this, the central portion and the lateral portion have the same meaning as those of the corresponding C-shaped component 4.

In greater detail, the pallet according to the invention uses:

- first C-shaped components 4 intended to form the lower base of each plinth 18, the two end closures of the plinth and the terminal portions of its upper base;
- second inverted U-shaped components 6 intended to form, alone or with identical components 6, according to the type of pallet, the upper base of each plinth 18 and to contribute to the formation of its two outer uprights. In the case of pallets using two second components 6 for each plinth 18 (see FIG. 1), each of these second components 6 also contributes to the formation with its inner lateral portion the intermediate upright of the plinth 18;
- third inverted U-shaped components 8 intended to form, with other identical components, the transverse connections between the plinths 18 and to form with their central portion a part of the platform 20 of the pallet, and to contribute to the formation of the outer uprights and possibly the intermediate upright of the two plinths 18;

fourth components 10 of rectilinear shape, intended to form with other identical elements that part of the platform 20 not formed by the central portion of the third components 8, and to also form lower cross ties for connecting the pallets 18.

While the first two components 4 and 6 are always present, the presence of the third components 8 and/or fourth components 10 is related to the type of pallet and its use for which it is intended; consequently the present invention relates not only to pallets in which the platform is made with third components 8 and fourth components 10, but also to pallets in which the platform is made only with third components 8 or only with fourth components 10.

While the fourth component 10, if used, is in any event rectilinear, and is hence formed from a rectilinear piece of basic ribbed profile 2, the first three components 4, 6, 8 are obtained starting from a piece of basic ribbed profile 2, cut to size and then bent about transverse axes passing through the base plane 14 at bending apertures provided in the lateral walls 19 and 22 of ribs 12 and in the outer lateral ribs 16 of the basic profile 2.

In a preferred production method for these profiles, by shearing using a stepping die or by other traditional methods a series of apertures are provided in the flat steel sheet strip located both in those zones in which the 90° bend is provided in the profile, based on the specific shape of the component to be obtained, and in those zones in which snap-engagement or connection with other components is to take place. At this stage, apertures are not formed in those zones which will become the ends of the piece of profile intended to form each component.

The flat strip sheared in this manner is then subjected to profiling to be transformed into the ribbed profile 2, with the two longitudinal ribs 12 of rectangular cross-section, which extend from the base plane 14 of the portion, coinciding with the plane of the sheet metal strip, and with the outer lateral webs 16 which extend perpendicularly from the base plane 14 and are bent at their top towards the interior of the profile, coplanar with the top 17 of the rectangular ribs 12.

The profile 2 obtained in this manner can then be subjected to further pressing to move certain tabs, which may have been obtained in the same plane in certain components during the previous shearing steps, to outside their initial plane and make them therefore suitable for irreversible snap-engagement with other components.

Finally the continuous pressed profile is subjected to shearing which with a single operation separates each piece of the desired length from the continuous profile while at the same time giving the ends of each piece the shape suitable for subsequent engagement of the component obtained from that piece, with other components.

After all the pieces which form the different components of a pallet have been cut to size, they are ready for bending and assembly, which is done preferably not in their place of production but in their place of use, to which the various profile pieces are dispatched in rectilinear conditions, which is a very simple matter given their very small overall size.

In their place of use the pieces are stored in this minimum size state until the pallet is to be formed. When the pallet is required, the various pieces which are no longer to remain rectangular, i.e. the first, the second and the third component, the various pieces are bent together through 90° so that they assume their final C or U configuration, to be able to be assembled together. During assembly, the first C-shaped component 4 (FIG. 5) is disposed such that its central portion 24 rests on the platform ad the two adjacent lateral portions 26 point upwards. Then, two second inverted U-shaped components 6 (FIG. 6) are positioned mutually aligned within the first component 4, such as to engage, with the free end of their lateral portions 28, corresponding portions of the central portion 24 of the first component 4, and to be engaged, with an aperture thereof provided at the end of their central portion 30 close to the terminal portions 32 of the first component 4, by the free end of each terminal portion 32.

in this manner three plinths 18 are formed, which are positioned at the correct distant apart which they will have in the formed pallet.

The three plinths 18 are then stabilized in their position by the use of three third inverted U-shaped components 8 (FIG. 7). The two outer third components 8 are snap-connected with their central portion 34 simultaneously with the terminal portions 32 of the three first components 4 of the three plinths 18 and to the central portions 30 of the three second components 6, already connected to the respective first components 4.

The central third component 8 is then snap-connected with the central portion 34 simultaneously to the central portion 30 of the two second components 6 of each plinth 18. Moreover the free end of the lateral portions 36 of all three third components 8 are insertion-engaged in corresponding apertures provided in the central portion 24 of the first component 4 of the two outer plinths 18.

Finally the fourth components 10 (FIG. 8), if provided, are snap-fitted to the central portion 30 of the second components 6 of all three plinths 18, to form, together with the central portion 34 of the third components 8, the platform 20 of the pallet 2.

In some cases, lesser performance is required of the pallet, both in terms of useful loading area and in terms of capacity. in these cases the pallet can be provided with two instead of three plinths 18 and/or each of them can be formed by connecting a first C-shaped first component 4 to only one instead of two inverted U-shaped components 6, and/or the platform does not use four components 10 but is formed only from the central portion 34 of the third inverted U-shaped components 8, obviously spaced apart. In this case more than more than two or three third components 8 can be used, which with their central portions 34 engage only the central portion 30 of second components 6.

In other cases, in which more severe performance is required of the pallet, fourth components 10 are used to be snap-connected from below to the central portion 24 of the first components 4 to form lower crosspieces for connecting together the plinths 18, to further stiffen the pallet.

As stated, the components 4, 6, 8 and 10 present a plurality of apertures. In particular, these include substantially two main types of apertures: a first type of aperture 38, required for the 90° bending of the various components to make them assume an overall C- or U-shape, and a second type of aperture 46, to enable the portions of the various components to be insertion-engaged or snap-engaged with each other, to form a mutually stable connection therebetween.

Figure 4:
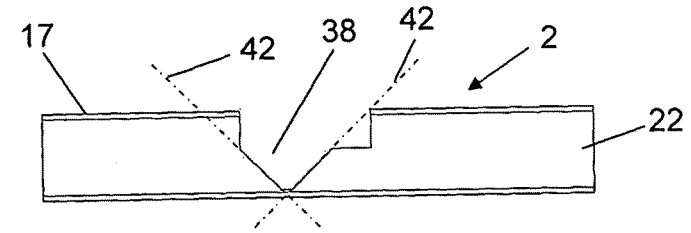

In particular, the apertures 38 provided in each profile to enable them to be bent at 90° are shaped such as to not only enable the adjacent portions of each profile piece to be bent at 90° to each other along a transverse line lying in the base plane 14 of the profile itself, but also to offer a counteraction against the exceeding of the value of 90° for this angle. To this end, as shown in FIG. 4, the apertures 38 of the first type are substantially rectangular in the top flat band 17 of the ribs 12, and of the lateral webs of the profile, and have their edges 42 inclined at ±45° to the profile base plane 14 in the lateral walls 19 and 22 of the ribs 12 and in the lateral webs 16 of the profile 2. These inclined edges 42 of the apertures 38 can be rectangular, as indicated by dashed lines in FIG. 4, or can comprise projections and complementary recesses, which better favour the stability of the support between the adjacent profile portions bent at 90° to each other.

The apertures 46 of the second type are provided in the profile base plane 14 and/or in the top band 17 of the ribs 12 and of the outer lateral webs 16 and preferably comprise vanes 48 which extend from the plane of the aperture 46 within the purpose of cooperating with portions of other components by mutual snap-engagement.

In greater detail, the first C-shaped component (see FIG. 5) presents:

- a first series and a second series of apertures of the first type 38, as heretofore defined, formed between the central portion 24 and the lateral portions 26, and between these lateral portions and the terminal portions 32,
- bending lines 44 which extend transversely at each series of apertures 38 to facilitate the 90° bending of the piece of profile 2 therealong,
- a plurality of apertures of the second type 46, provided in the top band 17 of each rib 12 at the centre and in proximity to ends of the central portion 24; these apertures also comprise snap-engagement vane 48,
- apertures 46 of the second type, formed in each terminal portion 32 and intended to be engaged by a part of corresponding portions of the central portion of third inverted U-shaped components 8,
- apertures 46 of the second type, formed in the central portion 24 and intended to be insertion-engaged by the free end of the lateral portions 28 of the second inverted U-shaped components 6 (FIG. 9),
- bent tabs 47 provided in the central band 15 of the basic profile 2 included between adjacent ribs 12.

In case the pallet has also to be provided with lower crosspieces connecting the plinths 18 together, the central portion of the first C-shaped component 4 is also provided with apertures 46 of the second type, engagable by the components 10 in a similar manner to those which form the platform 20.

The second component 6 of inverted U-shape presents:

- a series of apertures of the first type 38, formed between the central portion 30 and the lateral portions 28,
- bending lines 44 which extend transversely at said series of apertures 38 to facilitate the bending of the profile therealong,
- apertures 46 of the second type, formed in the central portion 30 and intended to be insertion-engaged by of corresponding apertures formed in the central portion 34 of the third inverted U-shaped components 8, and/or by the fourth rectangular components 10 to form the pallet platform 20,
- the free end of each lateral portion 28 shaped for engagement with the tabs 47 of the first component 4.

The third component 8 presents:

- a series of apertures of the first type 38, formed between the central portion 34 and the lateral portions 36,
- bending lines 44 which extend transversely at said series of apertures 38 to facilitate the bending of the profile therealong,
- groups of apertures 46 of the second type, formed in the central portion 34 and defining portions intended for inserting-engagement in the apertures 46 formed in the terminal portions 32 of the first C-shaped components 4 and in the central portion 30 of the second inverted U-shaped components 6.

The fourth rectangular component 10 (see FIG. 8) is substantially similar to the central portion 34 of the third inverted U-shaped components 8, and is therefore similar to a third component 8 without the lateral portions 36. It is provided with apertures 46 of the second type, and is provided with appendices intended for inserting-engagement in the apertures 46 formed in the central portion 30 of the second inverted U-shaped components 6 and, if required, in similar apertures 46 formed in the central portion 24 of the first C-shaped component 4.

As stated, the stability and the substantial irreversibility of the insertion-engagement or snap-engagement between corresponding parts of different components is achieved by providing the edges of the apertures 46 with vanes 48, which yield temporarily during pallet assembly, to then elastically reassume the originals configuration, determining in this manner the stable and irreversible engagement between the components involved in this assembly stage. Naturally the shape, dimensions and arrangement of these vanes 48 are to some extent free, in the sense that they are left to design criteria, which do not modify the essence of the invention.

Figure 9:
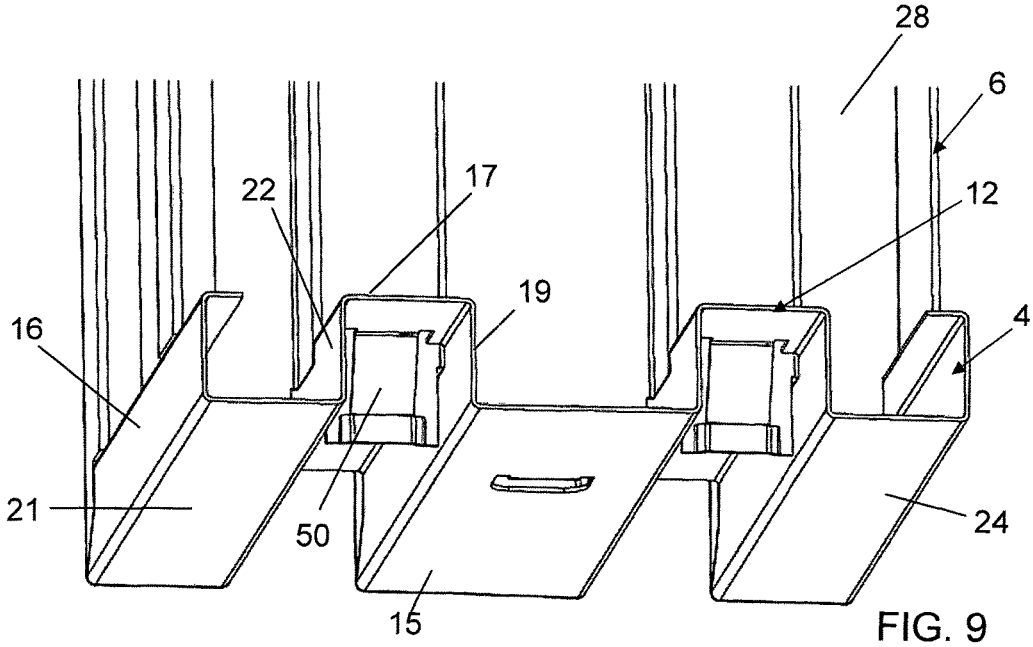

FIG. 9 shows the connection of the free end of a lateral portion 28 of a second inverted U-shaped component 8 to the central portion 24 of a first C-shaped component 4. In particular, this connection is achieved by causing extensions 50 of the free end of the lateral portion 28 of the second inverted U-shaped component 6 to penetrate into corresponding apertures provided in the top 17 of the ribs 12 of the central portion 24 of the first C-shaped component 4.

Figure 10:
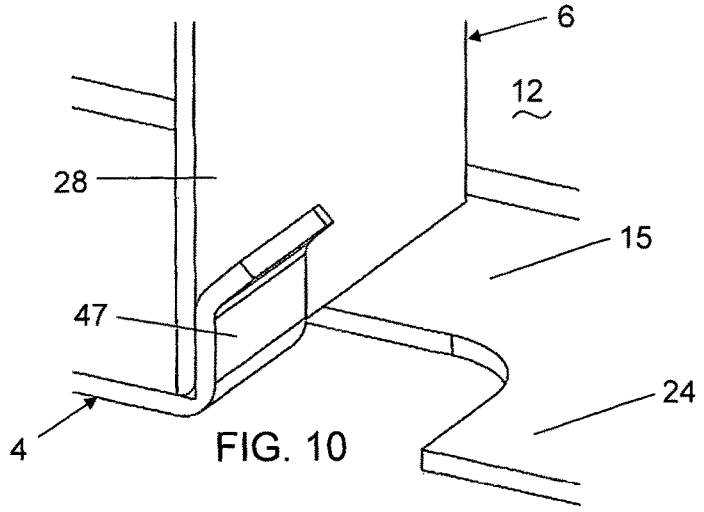

FIG. 10 shows instead the connection between the same components at the central band 15 of the first C-shaped component 4, bounded by two adjacent ribs 12. In greater detail, the free end of each lateral portion 28 engages with the corresponding tabs 47 provided in the central portion 24 of the first component 4.

Figure 11:
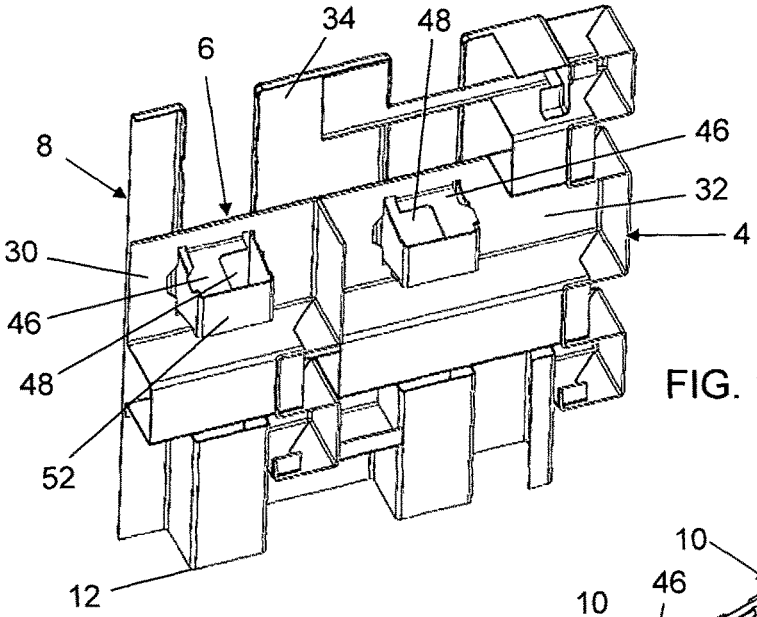

FIG. 11 shows the simultaneous connection of the central portion 34 of a third inverted U-shaped component 8 to the terminal portion 32 of the first C-shaped component 4 and to the central portion 30 of the second inverted U-shaped component 6. More particularly, a series of apertures formed in the ribs 12 of the central portion 34 of the third inverted U-shaped component 8, define portions 52 of rib 12, which form a sort of appendices insertable into corresponding apertures 46 formed both in the terminal portion 32 of the first C-shaped component 4, and into the central portion 30 of the second inverted U-shaped component 6 and snap-lockable in this position by the already described elastic vanes 48.

Figure 12:
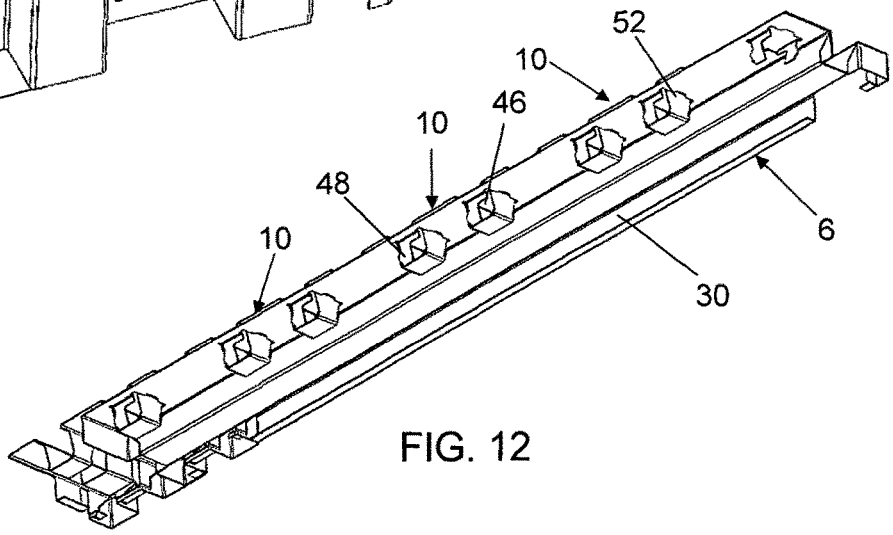

FIG. 12 shows the connection of a plurality of fourth rectilinear components 10 to the central portion 30 of a second inverted U-shaped component 6. It can be seen in particular that each fourth component 10 is provided with a plurality of apertures, which define portions 52 of ribs 12 insertable into apertures 46 formed in the central portion 30 of the third component 6 and, thanks to the presence of elastic vanes 48 operating in the already described manner, ensure stability of the connection between the components.

Figure 13:
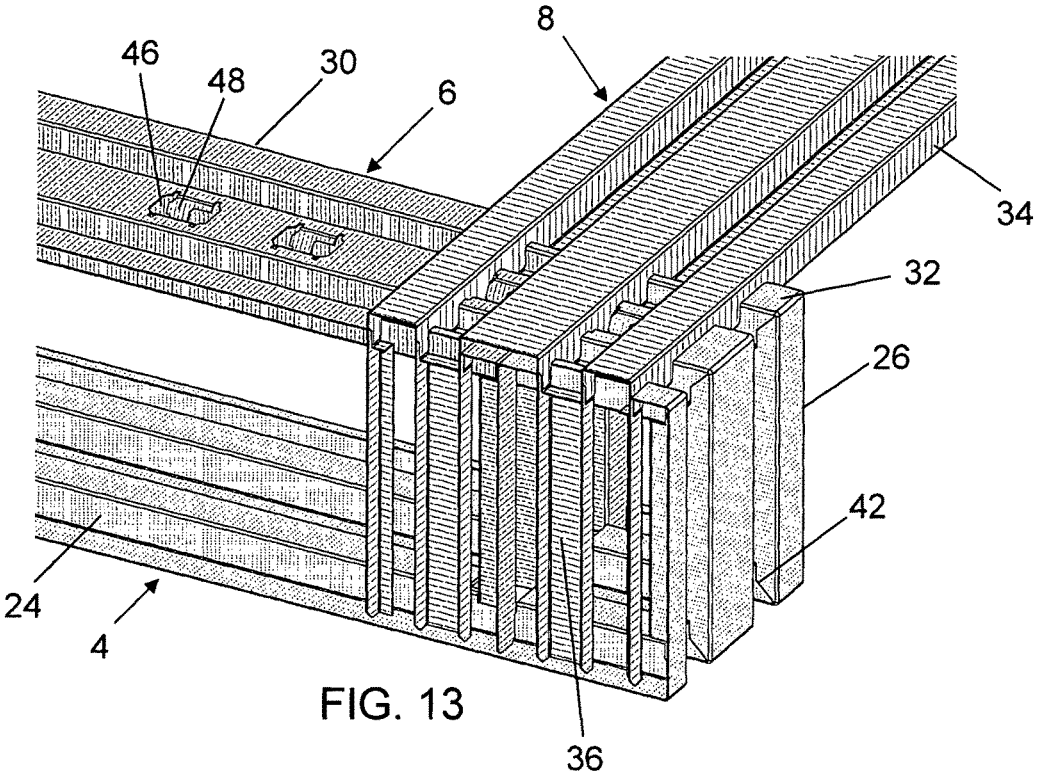

FIG. 13 shows in sectional view on a vertical plane, the node at which a first C-shaped component 4, a second inverted U-shaped component 6 and a third inverted U-shaped component 8 join together. It can be seen that the central portion 34 of the third inverted U-shaped component 8 is inserted-fitted, in the already described manner, both to the terminal portion 32 of the first C-shaped component 4, and to the central portion 30 of the second inverted U-shaped component.

Figure 14:
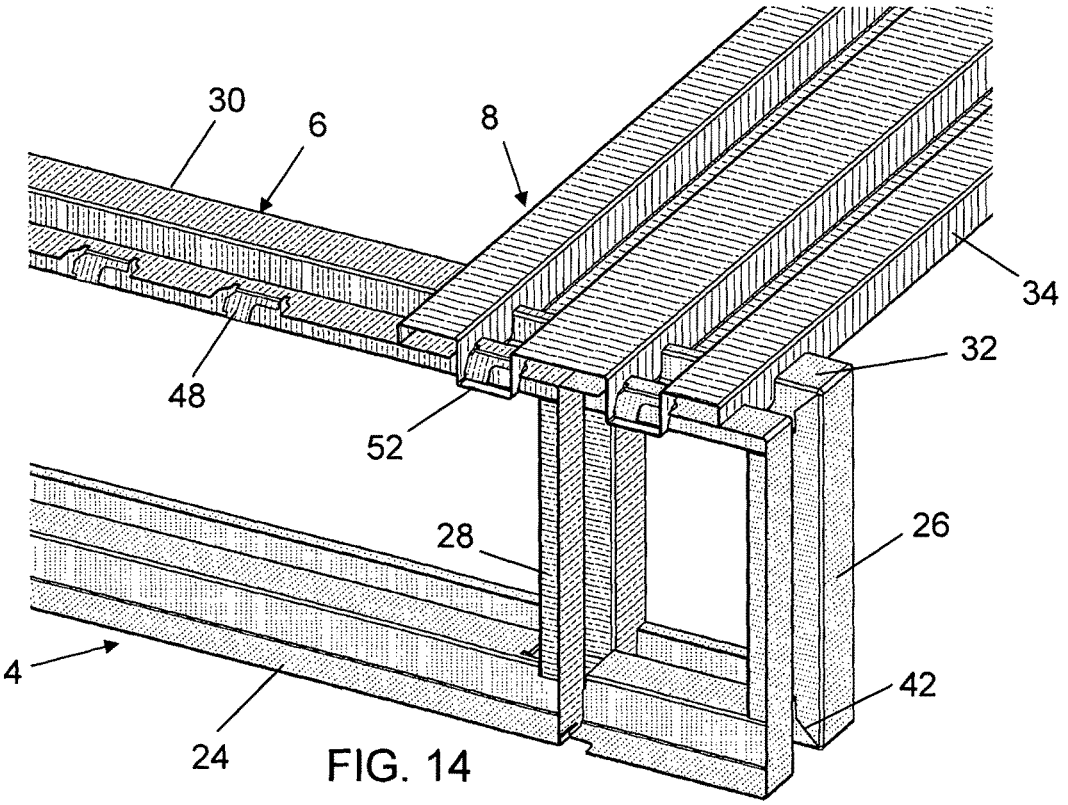
Figure 15:
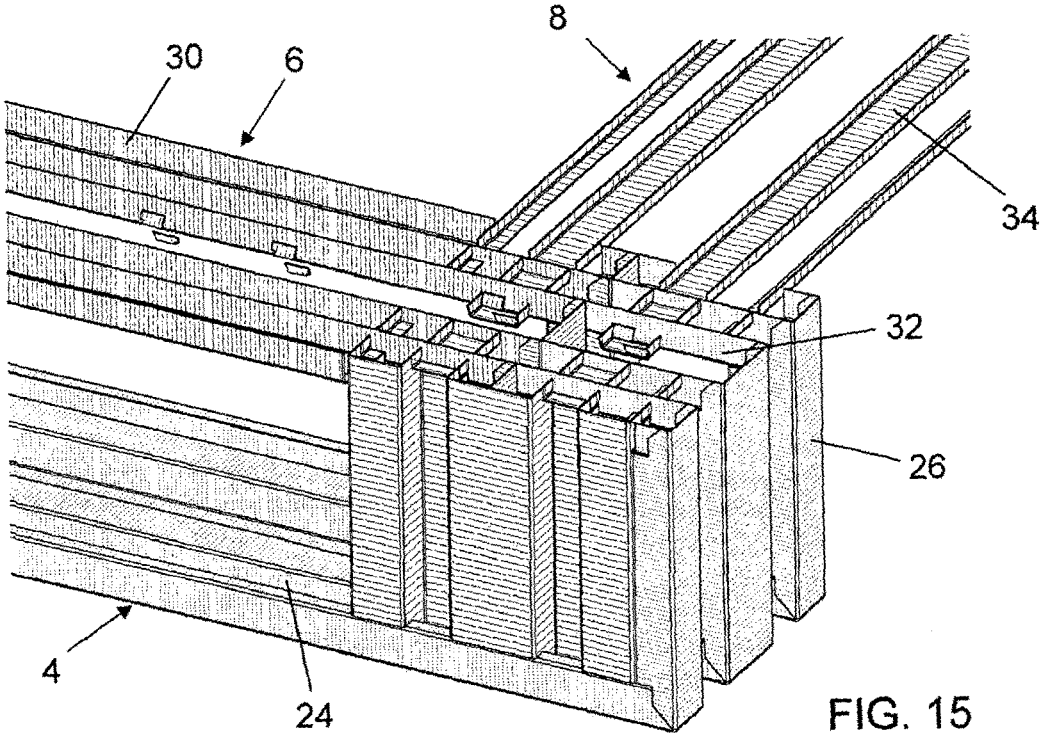

FIGS. 14 and 15 show different section of the same node, which display further details of the manner of connecting together these three different components.

Figure 16:
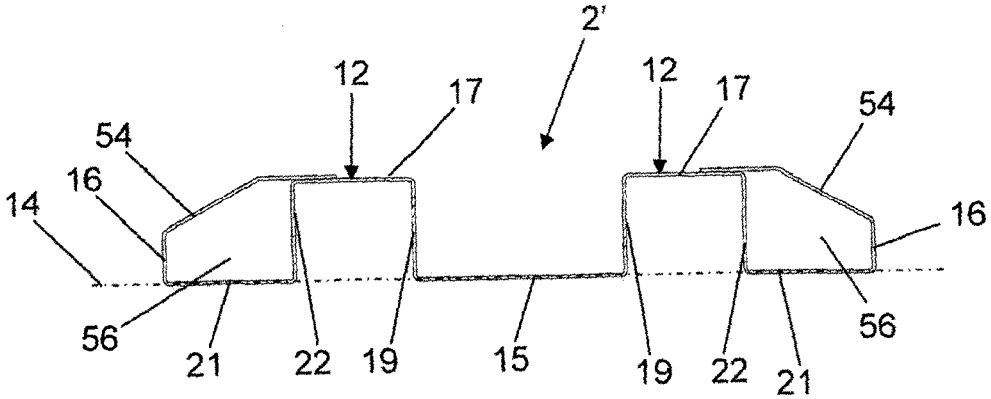

All the described pallet components 4, 6, 8, 10 can also be produced with a single basic profile 2' such as that shown in FIG. 16. In particular, this profile differs from that previously described by presenting the outer lateral vanes 16 firstly bent upwards from the base plane and then simultaneously upwards and towards the interior, in a pattern which forms an inclined plane 54 and causes the edge of each vane to adhere to the top 17 of the adjacent rib 12, to be then fixed thereto preferably by clinching to form a continuous tubular element 56.

This type of basic profile presents as greater flexural and torsional rigidity than the preceding, to the advance of pallet performance, which also presents another important advantage: more specifically it enables the lower portion of the cut-outs formed in the pallets to have an inclined lead-in surface, which simplifies the insertion into said cut-outs of the prongs of a lifting fork of a pallet truck. It is in fact well known that this insertion requires said lower portion to be overcome by the wheels present in said prongs of the fork of the pallet truck.

Figure 17:
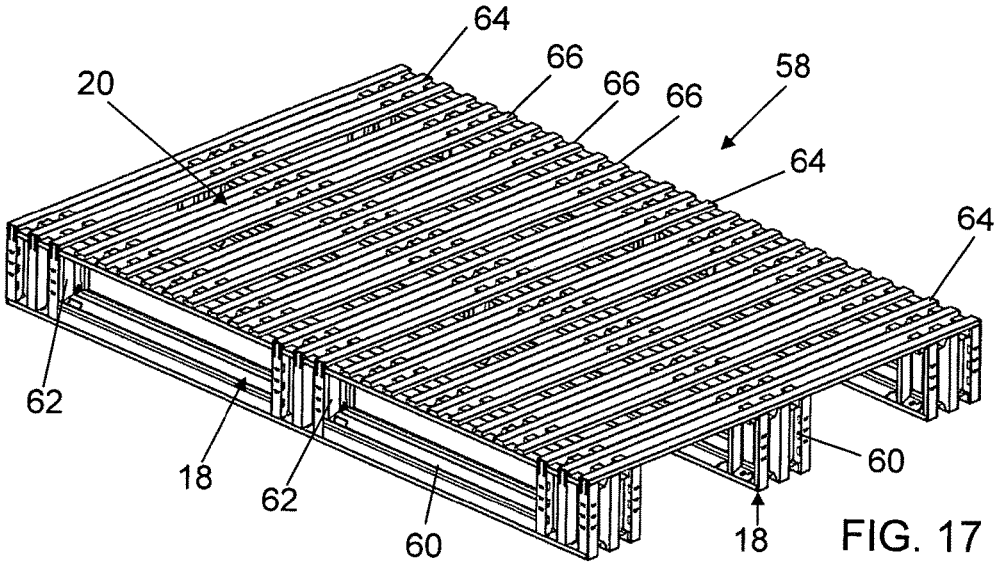
Figure 18:
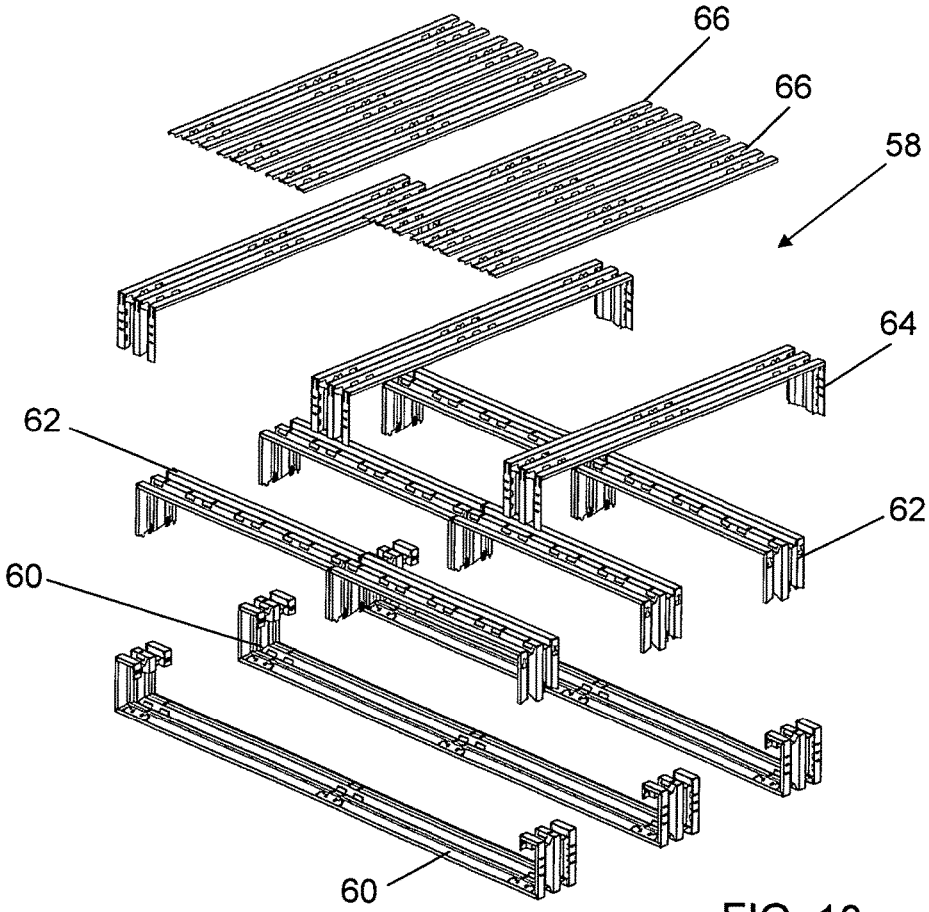

Figures from 17 to 43 show a different embodiment of a pallet. This is also formed with components obtained from a single metal profile, which can be that shown in FIG. 3 or in FIG. 16. FIG. 17 shows in particular a pallet 58 using four components, namely:

- first C-shaped components 60 corresponding to the first components 4 of the pallet of the first embodiment; in particular, the first components 60 are intended to form the lower base, the terminal portions and part of the upper base of each plinth 18,
- second inverted U-shaped components 62 substantially corresponding to the second components 6 of the pallet of the first embodiment; in particular the second components 62 are intended to define either alone or with identical components 62 the upper base and the uprights of the plinth 18,
- third inverted U-shaped components 64 substantially corresponding to the third components 8 of the pallet of the first embodiment; in particular the third components 64 are intended to define the transverse connections between the plinths and with their central portion they form part of the platform 20 of the pallet, and with their lateral portion form the lateral uprights of the plinths 18,
- fourth rectilinear components 66, substantially corresponding to the fourth components 10 of the pallet of the first embodiment; in particular, the fourth components 66 are intended to define that part of the platform 20 not formed by the third components 64.

Figure 19:
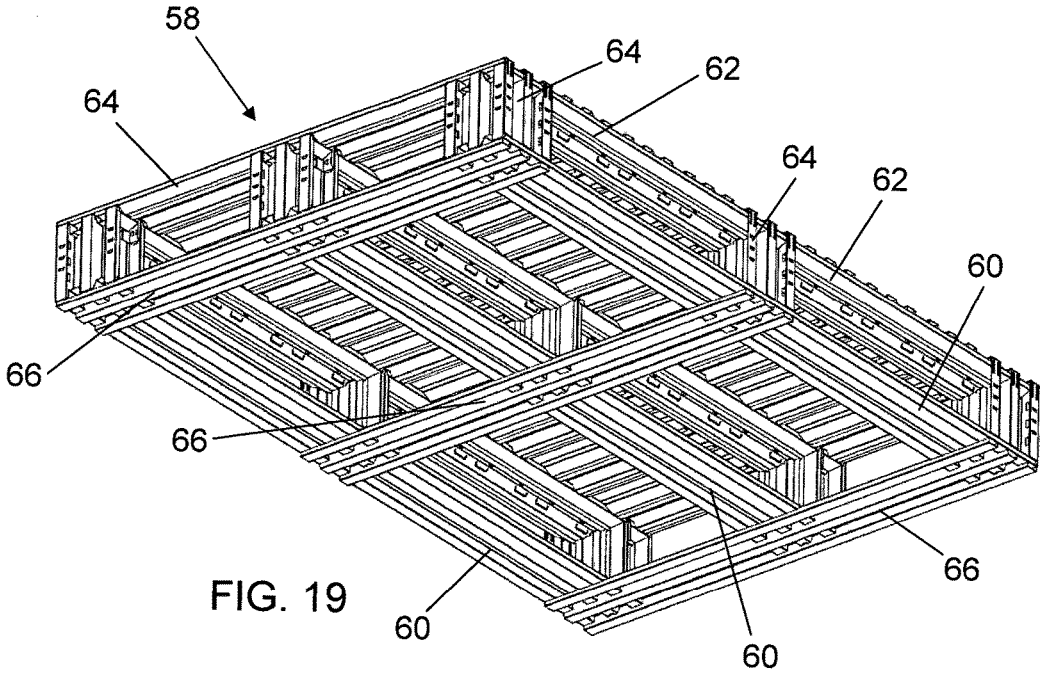

As shown in FIG. 19, the fourth components 66 can also form lower crosspieces connecting the plinths 18 together.

Figure 20:
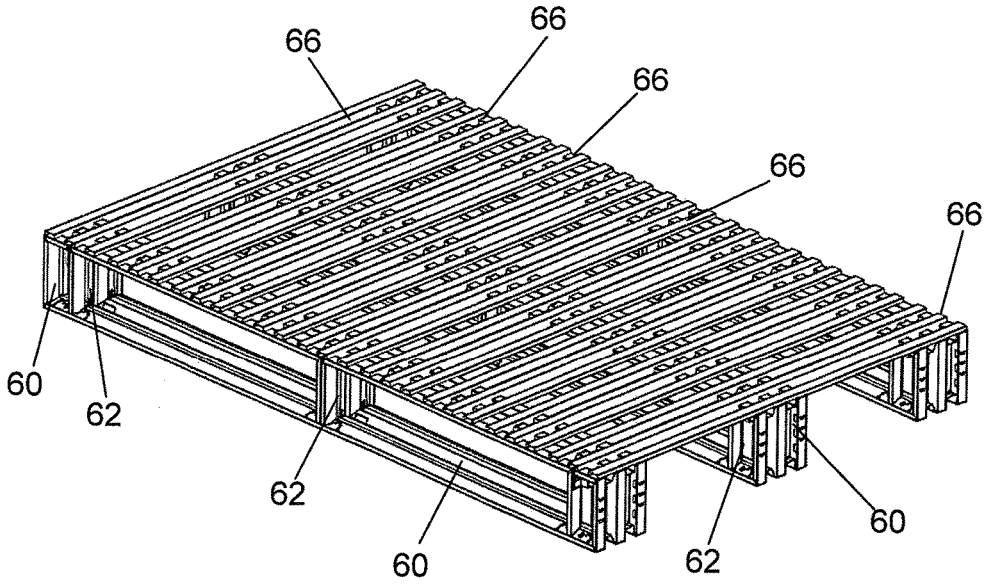

Moreover, in the variant shown in FIG. 20, the pallet 58 can comprise only first components 60, second components 62 and fourth components 66. In other words, the third components 64 can be absent, in which case the pallet platform is defined by fourth components 66.

Relative to the first component 60 of the pallet 58, the term central portion means the horizontal portion which in the assembled pallet faces the C-shaped aperture of the component itself, lateral portion means each of the two upwardly extending adjacent vertical portions, upper horizontal portion means each horizontal portion adjacent to the lateral portion extending inwards, and terminal portion means the vertical portion adjacent to the upper horizontal portion extending downwards. Essentially, the first component 60 of the pallet 58 presents a central portion 24, two lateral portions 26, two upper horizontal portions 32 and, in contrast to the first component 4, also presents two vertical terminal portions 68.

The second components 62 and the third components 64 comprise a horizontal central portion, 30, 34 respectively, interposed between two vertical components, 28, 36 respectively.

The components of the pallet 58 substantially present the same characteristics previously described with reference to the corresponding components of the pallet of the first embodiment of Figures from 1 to 15. In particular, the components of the pallet 58 present both apertures 38 of the first type, required to enable the adjacent portions of the basic ribbed basic profile 2 or 2' to be bend through 90°, to cause them to assume an overall C- or U-shaped form, and apertures 46 of the second type, intended to enable the portions of the various components to be insertion-engaged or snap-engaged, to form a stable mutual connection therebetween.

However, although the methods of assembling the components of the pallet 58 of this embodiment are substantially similar to those of the pallet of the first embodiment shown in FIGS. 1-15, it uses different methods for connecting the individual components together. These connection methods are described hereinafter, referred to components 60, 62, 64 and 66 obtained starting from a single profile 2' of the type shown in FIG. 16.

Figure 21:
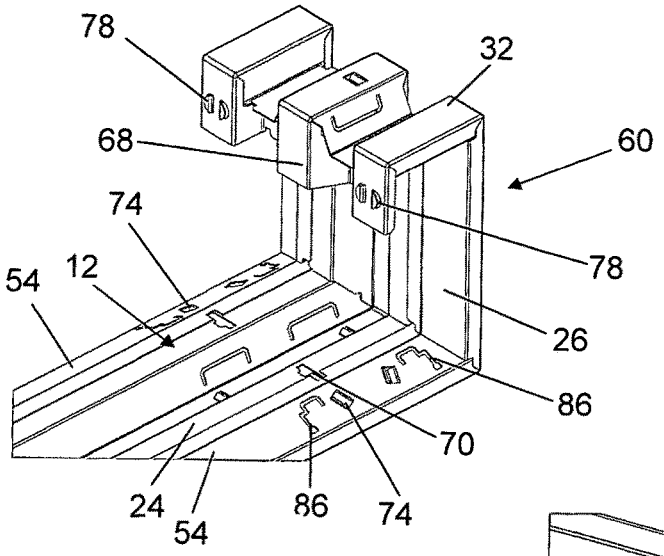
Figure 22:
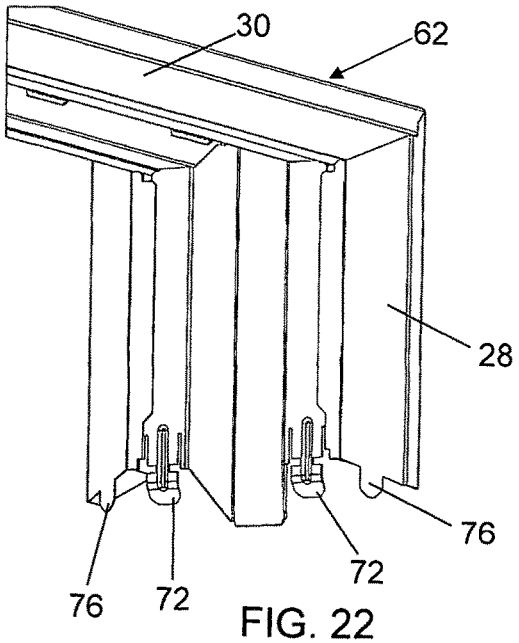
Figure 23:
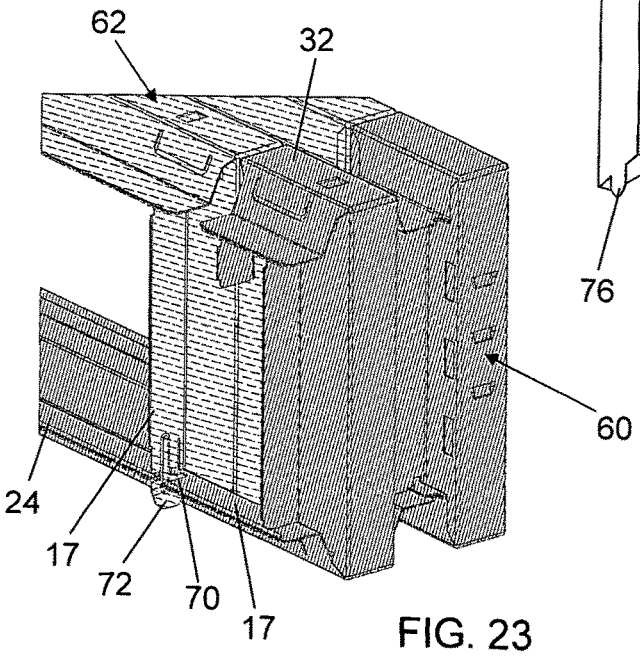

In greater detail, the first component 60 presents, in the end zones of the central portion 24, first slits 70 formed in the top band 17 of the ribs 12 of the profile 2 (see FIG. 21). First tabs 72 which extend from the ends of the lateral portions 28 of the second components 62 snap-engage in these first slits 70 (see FIGS. 22-23).

Figure 26:
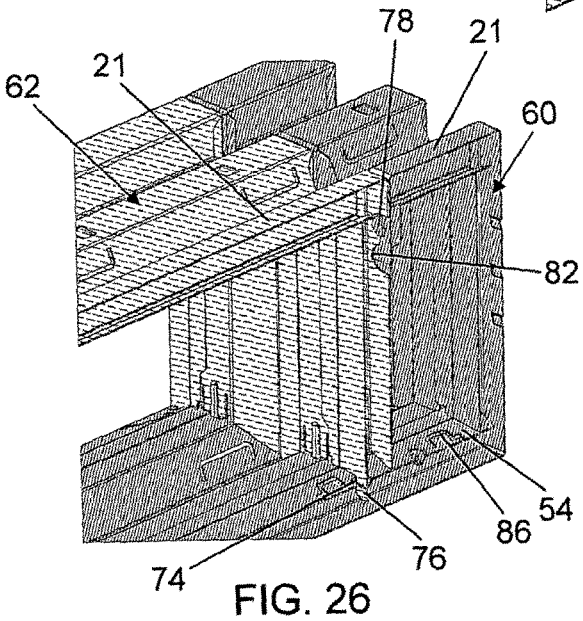

In addition, the first component 60 also presents in the end zones of the central portion 24 second slits 74, which are formed in the respective inclined bands 54 of the profile 2' (see FIG. 21). Second tabs 76 which extend from the ends of the lateral portions 28 of the second components 62 insertion-engage in these second slits 74 (see FIGS. 22, 24 and 26).

Figure 24:
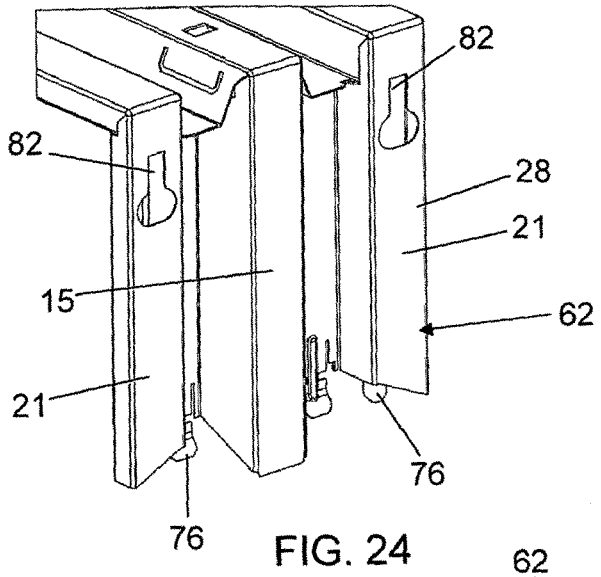
Figure 25:
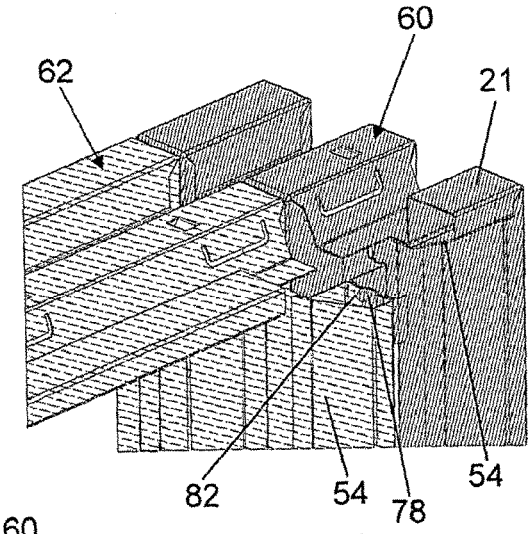

In the lateral bands 21 of the profile 2', the vertical terminal portions 68 of the first component 60 present shaped projecting zones 78 (see FIG. 21), while shaped windows 82 are defined in the base lateral bands 21 of the lateral portions 28 of the second components 62 (see FIG. 24). By virtue of this configuration the shaped projecting zones 78 of the first component 60 are arranged to enter and engage in the interior of the corresponding shaped windows 82 of the second component 62 (see FIGS. 25 and 26).

Figure 27:
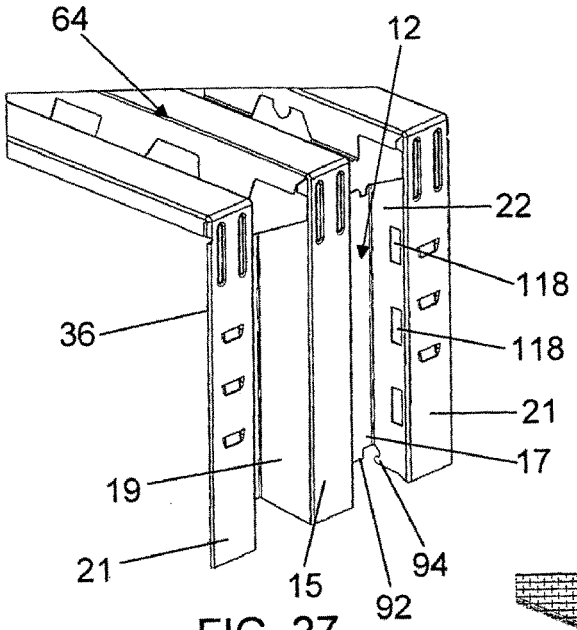
Figure 28:
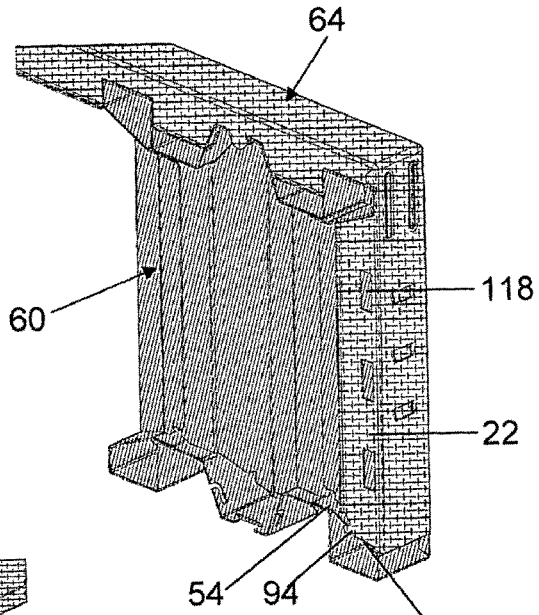
Figure 29:
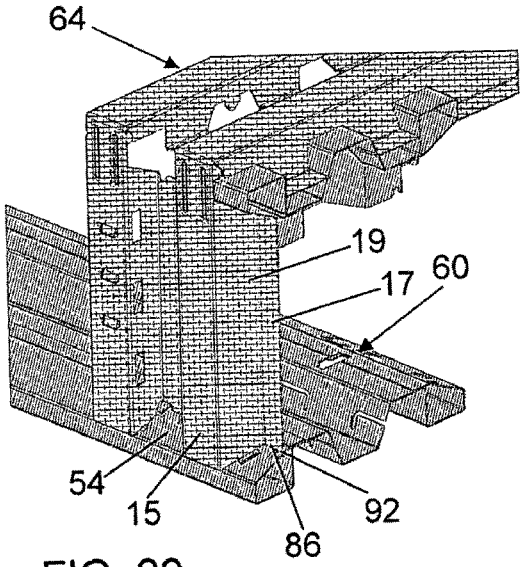

Third shaped slits 86 (see FIG. 21) are provided in the inclined surface 54 of the profile 2 which forms the first component 60, and more specifically in the end zones of the central portion 24, intended to be insertion-engaged by corresponding vanes 92 and 94 provided in the free edge of the lateral portions 36 of the third component 64 (see FIGS. 27-29).

Figure 30:
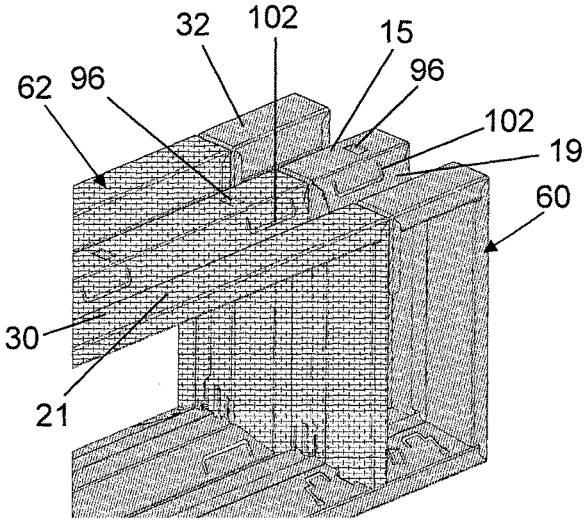
Figure 31:
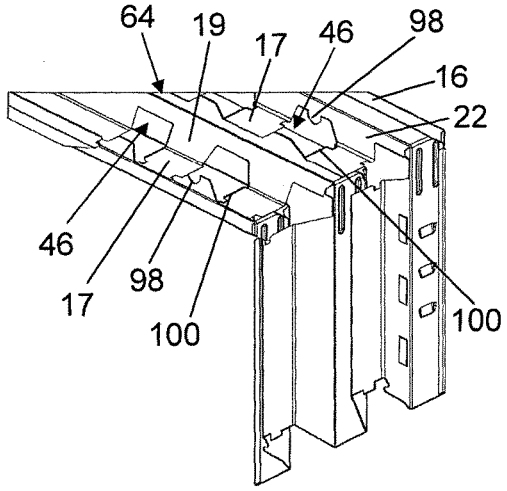
Figure 32:
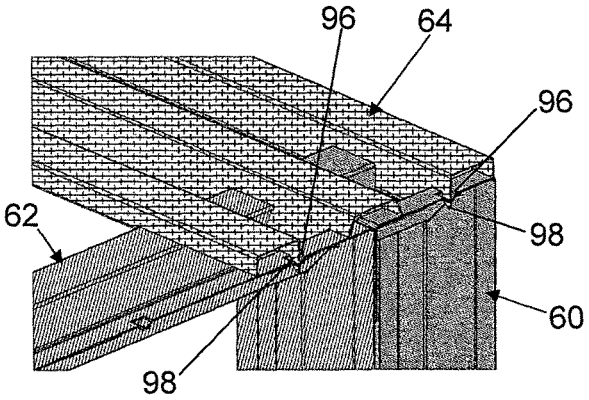
Figure 33:
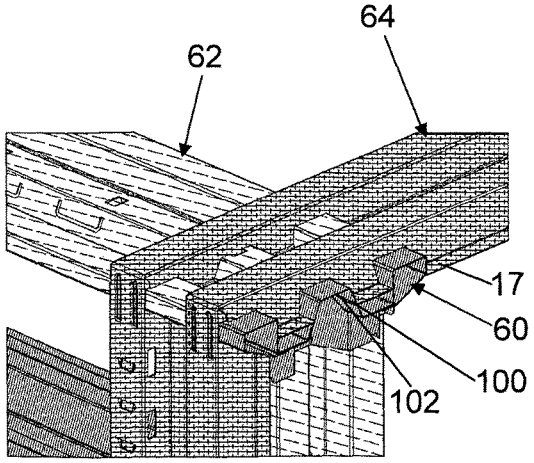

The central portion 34 of the third component 64 presents apertures substantially of the second type 46 described previously; in particular, the apertures 46 involve the top band 17 of the ribs 12 and part of the outer vertical walls 22 and inner vertical walls 19 which define said ribs 12. Moreover, in the apertures 46, the third component 64 presents only the outer lateral vanes 16, i.e. the inclined longitudinal bands 54 are absent. In some of these apertures 46, teeth 98 and tabs 100 project from the edges thereof (see FIG. 31), to enter corresponding apertures 96 and 102 formed in the upper horizontal portions 32 of the first component 60 and in the central portion 30 of the second component (see FIGS. 30 and 32).

Figure 34:
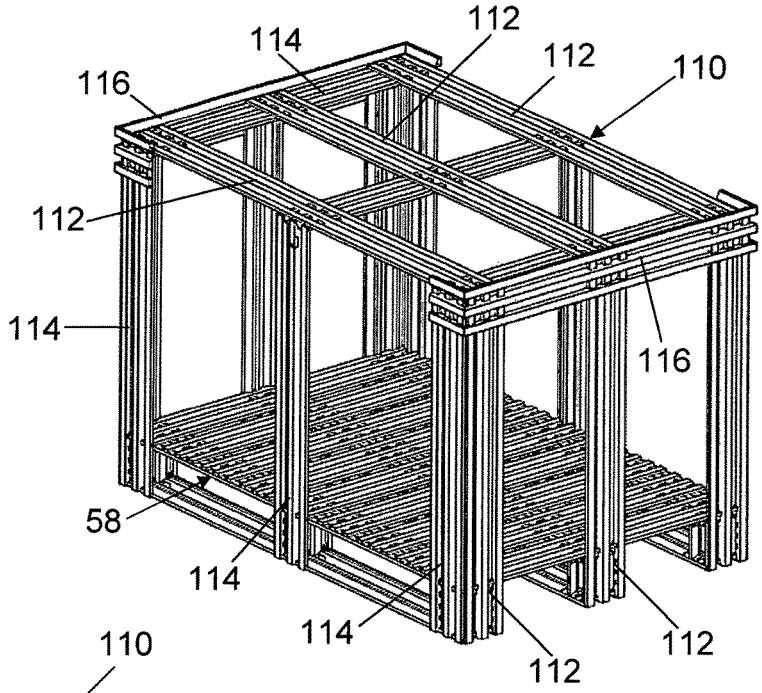

The pallet of the invention can also comprise an upper structure 110, shown in FIG. 34 and onwards, suitable to define a cage for containing goods positioned on the pallet loading platform.

The components of the upper structure 110 are also all obtained with pieces of profile 2 or 2' shown in FIGS. 3 and 16 respectively; moreover, these components are produced by the same production methods described heretofore with reference to the first pallet embodiment.

In particular, the structure 110 comprises:

- fifth inverted U-shaped components 112 consisting of two vertical portions interposed between a horizontal portion intended to be parallel to one of the pallet plinths,
- sixth inverted U-shaped components 114 consisting of two vertical portions interposed between a horizontal portion intended to be transverse to the pallet plinths,
- seventh C-shaped components 116 consisting of a central portion and two bent terminal portions.

Figure 35:
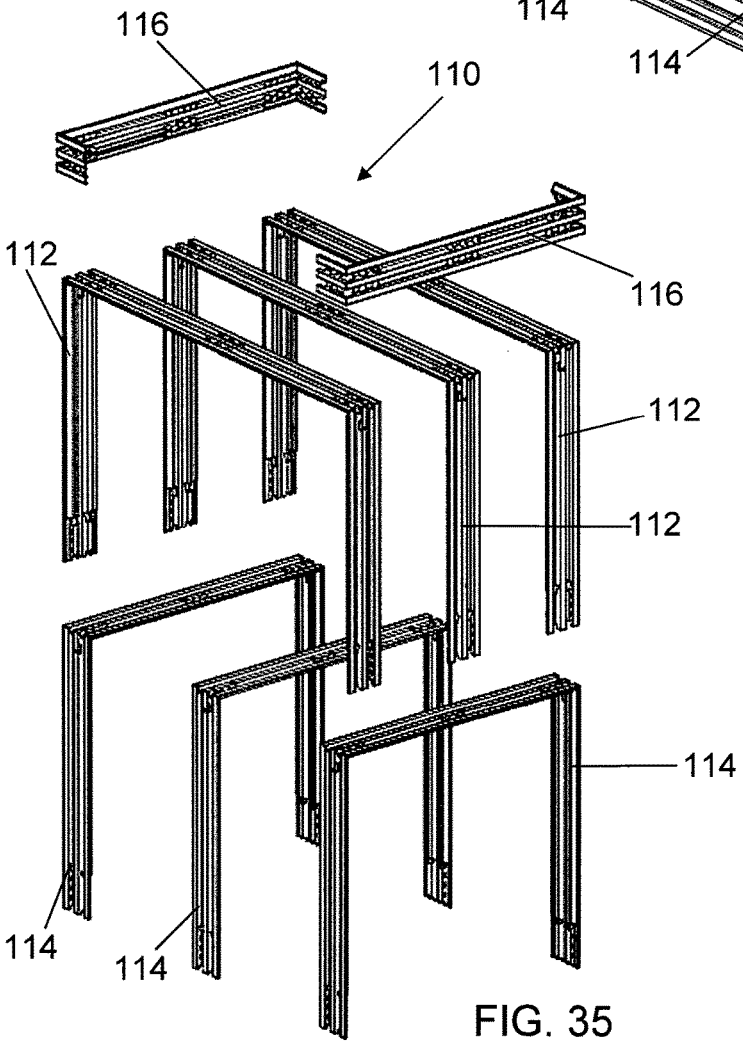

Although the embodiment of FIGS. 34 and 35 comprises three fifth components 112, three sixth components 114 and two seventh components 117, more than two or three elements of each type could be provided, depending on the application. In particular, the fifth components 112, the sixth components 114 and the seventh components 116 could be suitably combined together to define the goods containment structure 110 most suitable for the application context and requirements.

The components of the structure 110 are connected together in the following manner. In particular, the lower end of the vertical portions of the fifth components 112 is intended to be connected to the lateral portion 26 of the first components 60, while the lower end of the vertical portions of the sixth components 114 is intended to be connected to the lateral portions 36 of the third components 64. In addition, the end portions of the central portion of the fifth components 112 is intended to be connected to the corresponding end portions of the central portion of the sixth components 114; this connection is further stabilized by using the seventh components 116. In greater detail, the terminal portions of the seventh components 116 are snap-connected to the upper end portion of the vertical portions of the sixth components 114, while the end portions of the central portion of the seventh components 116 are snap-connected to the corresponding upper end portion of the vertical portions of the fifth components 112.

The components of the structure 110 present both apertures 38 of the first type, necessary to enable the pieces of profile 2 or 2' to be bend through 90°, to cause them to assume an overall C- or U-shaped form, and apertures 46 of the second type, intended to enable the portions of the various components to be insertion-engaged or snap-engaged, to form a stable mutual connection therebetween.

In greater detail, the fifth components 112 (see FIG. 37) and the sixth components 114 (see FIG. 39) present apertures 46 substantially of the already described second type; in particular, the apertures 46 are provided in the top band 17 of the ribs 12 and in part of the outer vertical walls 22 and inner vertical walls 19 which define said ribs. Moreover, in the zones provided with the apertures 46, the fifth components 112 and the sixth components 114 present a transverse profile without the inclined bands 54.

Figure 36:
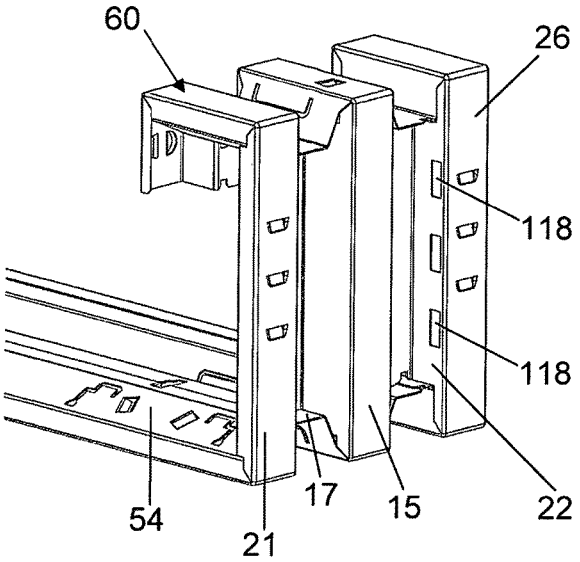
Figure 37:
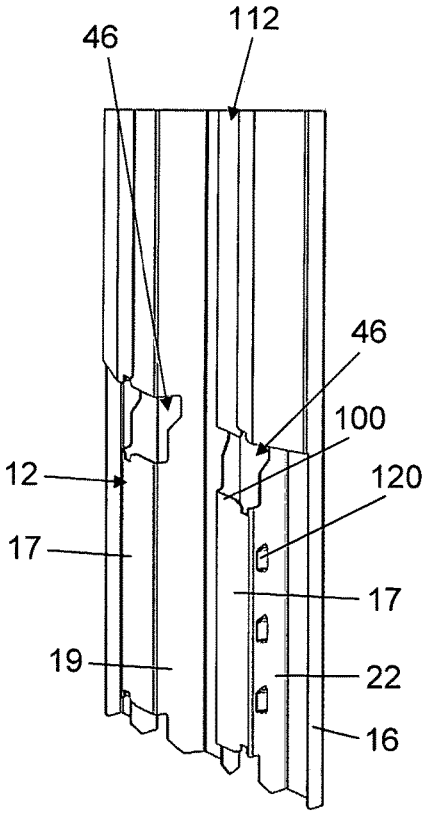
Figure 38:
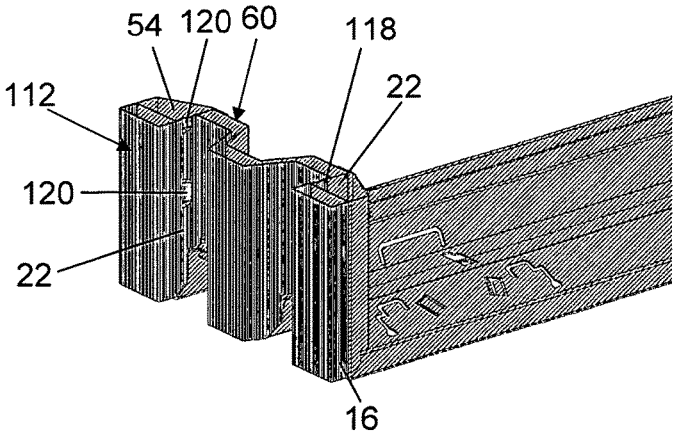

In the outer vertical walls 22 of the ribs 12 of the profile 2 which forms the lateral portions 26 of the first components 60 (see FIG. 36), vertically aligned apertures 118 are formed insertion-engaged by corresponding protuberances 120, also vertically aligned, provided on the outer vertical walls 22 of the ribs 12 of the profile 2 which forms the fifth components 112 (see FIGS. 37 and 38).

Figure 39:
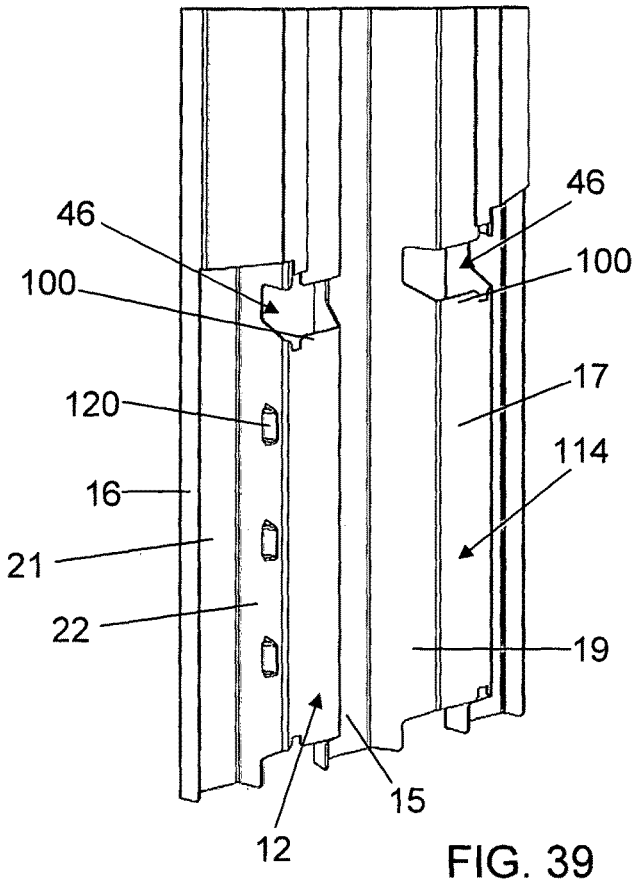
Figure 40:
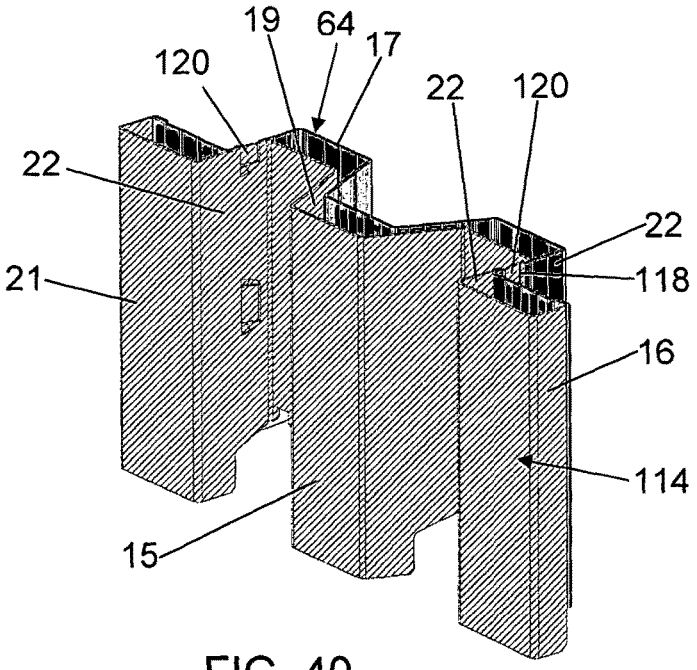
Figure 41:
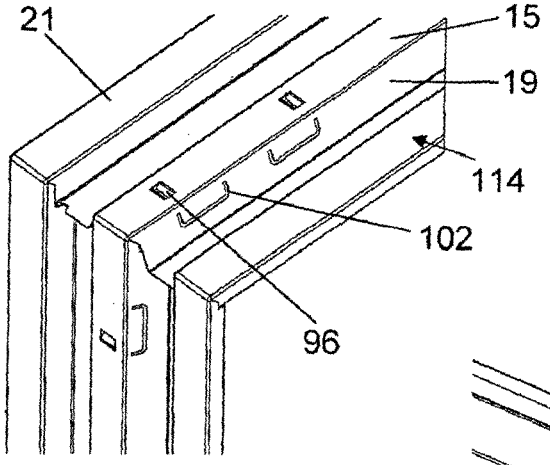

In the same manner, the outer vertical walls 22 of those ribs 12 of the lateral portions 36 of the third components 64 (see FIG. 27) are provided with vertically aligned apertures 118 insertion-engaged by corresponding protuberances 120, also vertically aligned, provided on the outer vertical walls 22 of the ribs 12 of the profile 2 which forms the sixth components 114 (see FIGS. 39 and 40).

Figure 42:
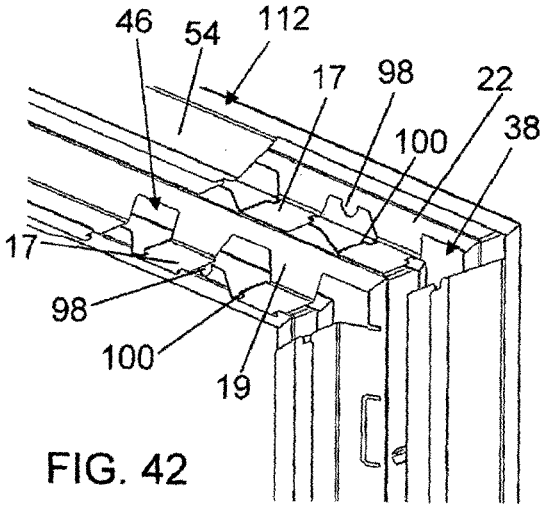
Figure 43:
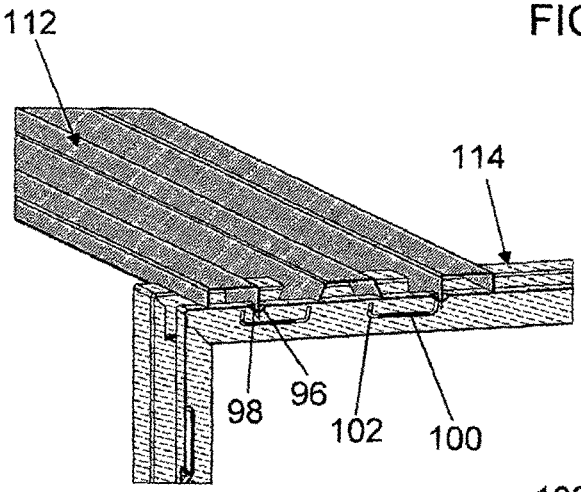

Apertures 46 of the second type are provided in the end portions of the central portion of the fifth components 112. In particular, a projecting tooth 98 (see FIG. 42) is provided in the apertures 46, on the outer vertical wall 22 of the ribs 12 of the fifth component 112, to engage in a corresponding slit 96 defined in the central longitudinal band 15 of the profile 2 which forms the sixth component 114 (see FIG. 43). Moreover, again, at the apertures 46, the top band 17 of the ribs 12 of the fifth component 112 comprises tabs 100 (see FIG. 42), intended to snap-engage in corresponding U-shaped cuts 102 provided in the inner lateral walls 19 of the sixth component 114 (see FIG. 43).

Figure 44:
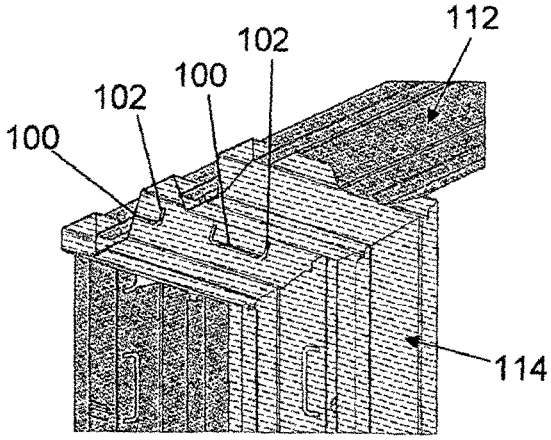

In greater detail, the projecting tooth 98 of the fifth component 112 is intended to engage in a slit 96 defined in the central base 15 of the profile defining the end of the central portion of the sixth component 114 (see FIG. 43), while the tab 100 of the fifth component 112 is intended to engage in the U-shaped cuts 102 defined in the inner vertical walls 19 of the profile defining the ends of the central portion of the sixth component 114 (see FIG. 44).

Apertures of the second type 46 are provided in the ends of the central portion of the seventh component 116, and in the terminal portions thereof. In particular, a projecting tooth 98 in the apertures 46, on the outer vertical walls 22 of the profile; in addition the top 17 of the ribs 12 is provided with tabs 100 (see FIG. 46).

In greater detail, the projecting tooth 98 of the seventh component 116 is intended to engage in a slit 96 defined in the central base 15 of the profile defining the ends of the vertical portions of the fifth component 112 and of the seventh component 114 (see FIG. 47); while the tab 100 of the seventh component 116 is intended to engage in a U-shaped slit 102 defined in the inner vertical walls 19 of the profile 112 and of the seventh component 114 (see FIG. 48).

Advantageously, all the components described and/or represented, both of the pallet and of the upper structure 110 can be made from micro-perforated sheet metal.

From the aforegoing it is apparent that the pallet of the invention is much more advantageous than traditional pallets in that:

- before its assembly, and hence during transport and possible storage in store, it is of particularly small overall size; in particular, a container of standard dimensions is able to contain a number of stacked modular components sufficient to product about 5000 pallets of the invention;
- the pallet configuration and its dimensions can be easily personalized based on user requirements simply by acting on the methods of pressing, shearing and bending the profile from which the four pallet components are produced;

the mounting/assembly operation is extremely simple and fast by virtue of being able to be carried out simply by bending and mutually inserting the various components; this operation can be carried out manually or, more advantageously automatically using suitable equipment;

using the same profile cut to size, bent and connected to the pallet components, an overhead structure can be produced constituting a cage for forming a sort of three-dimensional container.

Figures from 49 to 52 show a packaging plinth 130 obtained totally from a single piece of profile 2 or 2', such as that described heretofore and shown respectively in FIGS. 3 and 16. However, according to a different embodiment, not shown, the packaging plinth 130 can also be produced as the previously described plinth 18, i.e. the plinth 130 can also consist of two different pieces of profile 2 or 2', one defining the so-called first component 4 or 60, and the other defining the so-called second component 6 or 62, as described in greater detail with reference to the embodiment of the pallet shown in Figures from 1 to 48.

The piece of profile for obtaining the plinth 130 is made by the same production method as previously described. In greater detail this method involves firstly forming in the flat sheet steel strip, by shearing by a stepping die or other traditional methods, a series of apertures located both in the zones in which the profile is to be bent at 90°, based on the specific form of the component to be obtained, and in the zones to receive and snap-engage or hook the ends of the piece.

The flat strip sheared in this manner is then subjected to profiling to be transformed into the ribbed profile 2 or 2', with the two longitudinal ribs 12 of rectangular cross-section, which extend from the base plane 14 of the profile, coinciding with the plane of the sheet metal strip, and with the outer lateral webs 16 which extend perpendicularly from the base plane 14. In particularly, the outer webs 16 are bent at their top towards the interior of the profile, coplanar with the top 17 of the rectangular ribs 12, as in the profile 2 (see FIG. 3), or define an inclined surface 54 provided with an edge which adheres to the top 17 of the adjacent rib 12, as in the profile 2' (see FIG. 16).

The profile 2, 2' obtained in this manner can then be subjected to further pressing to move certain tabs, which may have been obtained in certain portions of the piece during the previous shearing steps in the same plane, to outside their initial plane and make them therefore suitable for irreversible snap-engagement with other portions of the same piece.

Finally the continuous pressed profile is subjected to shearing which by a single operation separates each piece, each of which is intended to define a plinth, while at the same time giving the ends of each piece the shape suitable for its subsequent engagement with the interior of the apertures formed in the same piece.

After at least two pieces have been cut to size, they are ready for bending and assembly, which is done preferably not in their place of production but in their place of use, to which the various profile pieces are dispatched in rectilinear condition, which is a very simple matter given their very small overall size.

In their place of use the pieces are stored in this minimum size state until the pallet is to be formed.

The pieces are stored in their place of use in this minimum bulk condition until goods are to be packaged. When this requirement arises, each piece is suitably bent in its various portions at 90° until the configuration of the plinth 130 is defined (see FIGS. 49 and 51). In particular, each plinth 130 presents two cut-outs 131 for insertion of the prongs of a fork lift pallet truck or a motorized truck.

During packaging, at least two plinths 130 (each of which is obtained from a single piece of profile or, alternatively with two different pieces defining respectively said first component 4 or 60 and said second component 6 or 62) are positioned, mutually parallel, at a suitable distance apart, and above these, the packages to be contained are positioned in an orderly arrangement. Essentially, in this case no platform is provided, or rather the platform is defined by the packages themselves which are rested on the plinths 130.

Once all the packages have been disposed in order on the plinths 130, the assembly is packaged by applying a suitable traditional metal packaging strap. Preferably, on the plinths a single package is positioned which, by virtue of its structural rigidity and following application of the metal strap and to the plinths, constitutes a single assembly therewith.

In particular, the plinth 130 comprises:

a central portion 132, forming a first base of each plinth 130, two lateral portions 134, joined to the ends of said central portion and the end closure of each plinth, two horizontal portions 136, joined to said lateral portions 134 and disposed parallel to said central portion 132, to form all (see FIGS. 49 and 50) or part (see FIGS. 51 and 52) of the other base of each plinth 130, two terminal portions 138, joined to said horizontal portions 136, and extending downwards parallel to the lateral portions 134, to close and securely engage by their ends 140 the interior of apertures defined in the central portion 132.

Figure 49:
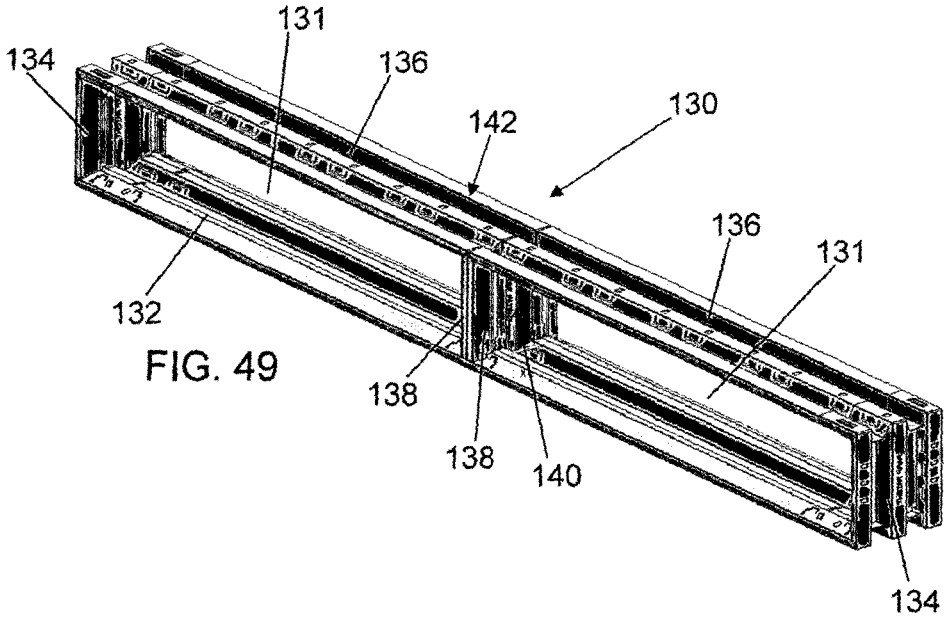
Figure 50:
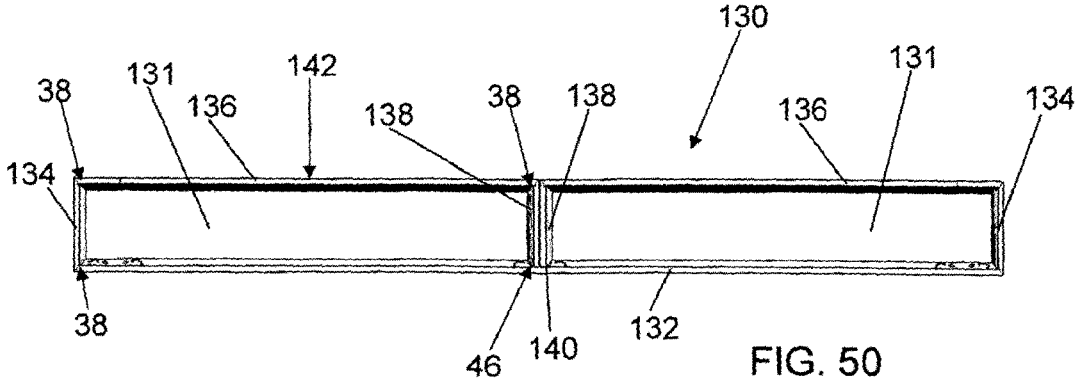
FIG. 50 is a lateral view thereof.
Figure 51:
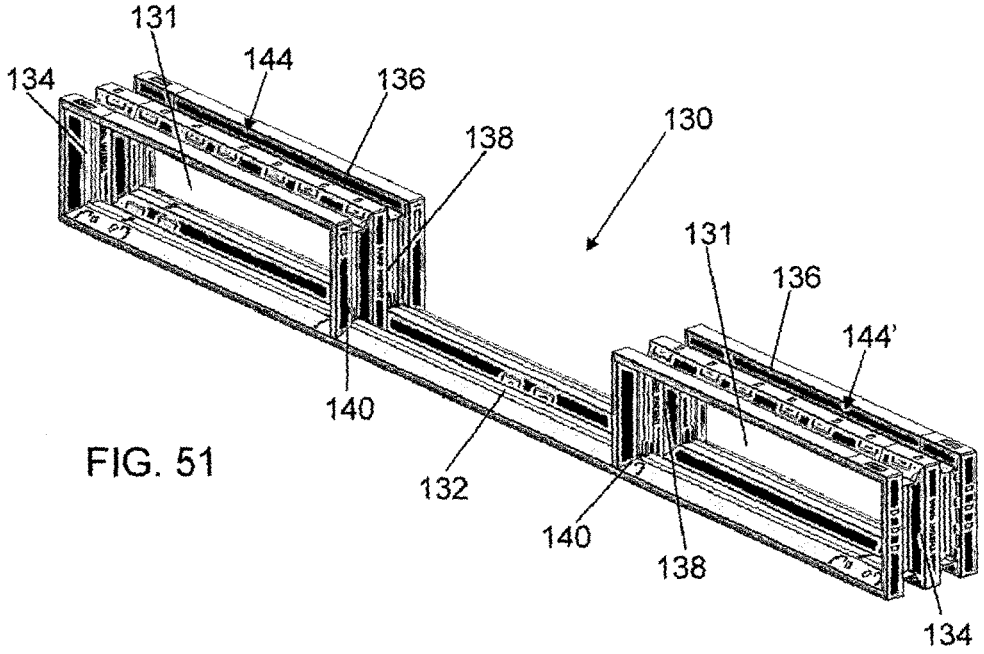
FIG. 51 is a perspective view showing a second embodiment of the packaging plinth.
Figure 52:
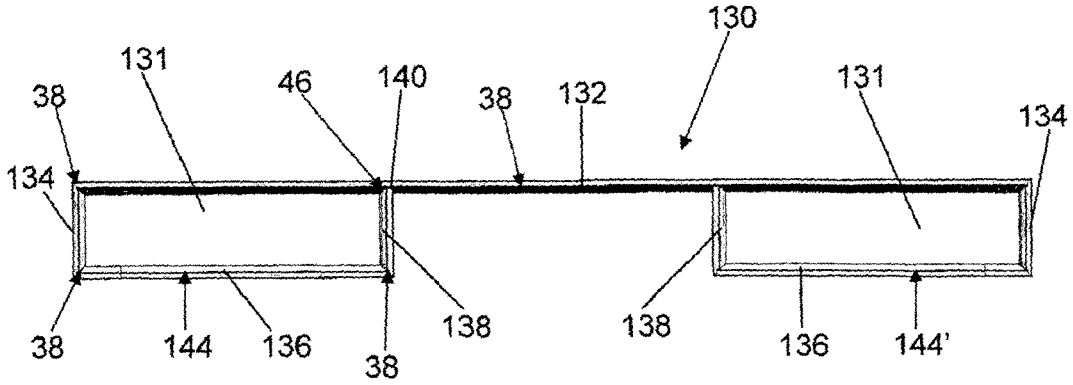
FIG. 52 is a lateral view thereof.

In greater detail, in the embodiment shown in FIGS. 49 and 50, the horizontal portions 136 have a length such as to be joining together and thus together define a substantially continuous single base 142 of length equal to the central portion 132; while in the embodiment shown in FIGS. 51 and 52, the horizontal portions 136 have a length such as not to define a single continuous base, but two separate portions 144 and 144' of said base.

Moreover, between the central portion 132 and the lateral portions 134, between these and said horizontal portions 135, and between these latter and the terminal portions 138, apertures 38 are provided, preferably such as those already described, both to enable said adjacent portions of the piece of profile to be bent at 90° to each other along a transverse line lying in the profile base plane 14, and to offer resistance to exceeding the value of 90° for this angle.

In greater detail, the central portion 132 presents, exactly in its central zone (see FIGS. 49 and 50) and/or in zones which are slightly spaced therefrom but symmetrical about the central zone (see FIGS. 51 and 52), apertures 46 of the second type, such as those described and represented heretofore, to enable insertion-engagement or snap-engagement of the ends 140 of the terminal portions 138, such as to form a stable connection for the piece when closed on itself.

Advantageously, means (not shown) for their connection and/or insertion-engagement or snap-engagement are provided between the central ends of the horizontal portions 136 and/or between the terminal portions 138. In greater detail, these connection and/or engagement means can be of one of the types previously described and illustrated.

From the aforegoing it is apparent that the plinths 130 are particularly advantageous in that they are quick and economical to produce and assemble, and are able to by themselves define a highly personalizable support on which to load the goods to be packaged.

The invention claimed is:

1. An assemblage metal pallet comprising:

at least two plinths (18) each provided with a cut-out and with a loading platform (20); and a plurality of components (4, 6, 8, 10, 60, 62, 64, 66) all obtained from a single piece of basic metal profile (2, 2'), a shape of which is symmetrical about a longitudinal central plane and is provided with at least one longitudinal rib (12) of rectangular cross-section and of constant height with respect to a base plane (14), and with two outer lateral webs (16) having an end portion bent inwards and at least partly coplanar with a top (17) of said rib (2), said components comprising:

a first component (4, 60) consisting of a piece of a basic profile (2) bent to C-shape with an aperture facing upwards and defining a central portion (24), forming a lower base of each plinth (18) of a pallet, two lateral portions (26) forming an end closure of each plinth, and two upper portions (32) joined to said lateral portions (26) and disposed parallel to said central portion (24), to form end portions of an upper base of each plinth (18), a second component (6, 62) consisting of a piece of the same basic profile (2) bent to an inverted U-shape, with a central portion (30) forming a part of the upper base of the plinth (18) and with two lateral portions (28) disposed perpendicular to said central portion (30) and engaged at one end to the central portion (24) of said first component (4, 60), and a further component (8, 64, 68) formed from a piece of the same basic profile (2), and constituting a crosspiece for connecting together said plinths (18), the further component, depending on pallet configuration and to a position of said further component (8, 64, 68), being snap-connected:

to the central portion (30) of at least the second component (6, 62) connected to the first component (4, 60) of each plinth (18), and/or to the central portion (30) of at least the second component (6, 62) connected to the first component (4, 60) and also to one of the upper portions (32) of said first component (4, 60) of each plinth (8).

2. The pallet as claimed in claim 1, wherein said further component comprises a third component (8, 64), formed from a piece of said basic profile (2) bent to an inverted U-shape to constitute a crosspiece for connecting together said plinths (18) and comprising a central portion (34) forming part of a pallet platform (20) and connected simultaneously, depending on the pallet configuration and on the position of said third component (8), to the central portion (30) of two second components (6, 62) or to the central portion (30) of one of the two second components (6, 62) and to a terminal portion (32) of the first component (4, 60), further also comprising two lateral portions (36) connected at a free end to the central portion (24) of the first component (4, 60) coupled to outer plinths (18).

3. The pallet as claimed in claim 2, wherein said further component comprises a fourth component (10, 66) formed from a rectilinear piece of said basic profile (2), and connected to the central portion (30) of the second components (6, 62) coupled to each plinth (8).

4. The pallet as claimed in claim 3, wherein the pallet platform (20) is formed from said fourth components (10, 66) and from the central portion (34) of said third components (8, 64).

5. The pallet as claimed in claim 3, wherein the pallet platform (20) is formed only from said fourth components (10, 66).

6. The pallet as claimed in claim 3, wherein said fourth component (10, 66) defines a connection crosspieces of the lower base of the plinths (18).

7. The pallet as claimed in claim 3, wherein those zones in which the profile is bent at 90°, pieces of profile (2) which form said first, second and third component (4, 6, 8, 60, 62, 64) comprise first apertures (38) provided to facilitate bending.

8. The pallet as claimed in claim 7, wherein said first apertures (38) comprise a rectangular portion provided in the top (17) of said web (12) and in said outer lateral webs (16), and a substantially isosceles triangular-shaped portion provided in lateral walls (19, 22) of said rib (12) and in the outer lateral webs (16) and defined by edges (42) inclined at 45° to the base plane (14) of the profile (2), a vertex of said isosceles triangle being positioned in said base plane (14).

9. The pallet as claimed in claim 8, wherein the inclined edges (42) of each first aperture (38) comprise at least one projection and at least one complementary recess.

10. The pallet as claimed in claim 7, wherein the pieces of profile (2) which define said first, second, third, and fourth components (4, 6, 8, 10, 60, 62, 64, 66) all present second apertures (46) configured to receive portions of the first, second, third, or fourth components.

11. The pallet as claimed in claim 10, wherein said second apertures (46) comprise apertures at the top (17) of said at least one rib (12) of the profile (2), part of vertical walls (22, 19) defining said at least one rib (12) and part of the outer lateral webs (16).

12. The pallet as claimed in claim 10, wherein said second apertures (46) are provided on at least one side with at least one elastic vane (48).

13. The pallet as claimed in claim 10, wherein, in said second apertures (46), teeth (98) and tabs (100) project to engage corresponding third apertures (96, 102) defined in another component.

14. The pallet as claimed in claim 10, further comprising an upper structure (110) configured to define a cage for containing goods positioned on the loading platform.

15. The pallet as claimed claim 14, wherein components of said upper structure (110) for containing goods are all obtained from a single type of basic metal profile (2, 2$^1$).

16. The pallet as claimed in claim 14, wherein components of the upper structure (110) for containing goods present said first apertures (38) for bending the pieces of said profile (2) through 90° to cause the pieces to assume an overall C-shape or U-shape.

17. The pallet as claimed in claim 14, wherein at least one of the components of the upper structure (110) for containing goods presents said second apertures (46) which are configured to enable insertion-engagement or snap-engagement between portions of the first, second, third, or fourth components, to form a stable mutual connection between the first, second, third, and fourth components.

18. The pallet as claimed in claim 14, wherein said upper structure comprises:

at least one fifth component (112) of inverted U-shape consisting of two vertical portions with an interposed horizontal portion adapted to be parallel to one of the pallet plinths (18), and at least one sixth component (114) of inverted U-shape consisting of two vertical portions with an interposed horizontal portion adapted to be transverse to the pallet plinths (18).

19. The pallet as claimed in claim 18, wherein said structure further comprises at least one seventh C-shaped component (116) consisting of a central portion and two terminal portions bent to further stabilize the connection between said fifth components (112) and sixth components (114).

20. The pallet as claimed in claim 19, wherein the pallet has at least one of the following configurations:

a lower end of the vertical portions of the fifth components (112) connected to the lateral portions (26) of the first components (60), a lower end of the vertical portions of the sixth components (114) connected to the lateral portions (36) of the third components (64), end portions of a central portion of the fifth components (112) connected to corresponding end portions of the central portion of the sixth components (114), terminal portions of the seventh components (116) engaged to an upper end portion of the vertical portions of the sixth components (14), or end portions of a central portion of the seventh components (116) engaged to corresponding upper end portions of the vertical portions of the fifth components (112).

21. The pallet as claimed in claim 19, wherein said first, second, third, fourth, fifth, sixth, and seventh components (4, 6, 8, 10, 60, 62, 64, 66, 112, 114, 116) are made from sheet metal having a plurality of holes defined therein.

22. The pallet as claimed in claim 18, wherein said first components (60) comprise four vertically aligned apertures (118), in which corresponding vertically aligned protuberances (120) provided in said fifth components (112) are engaged.

23. The pallet as claimed in claim 18, wherein said third components (64) comprise four vertically aligned apertures (118), in which corresponding vertically aligned protuberances (120) defined in said sixth components (114) insertion-engage.

24. The pallet as claimed in claim 14, wherein at least one of said components (112, 114, 16) of said upper structure (110) for containing goods presents said second apertures (46) provided with a projecting tooth (98) and with at least one tab (100) configured to engage in corresponding third apertures (96, 102) defined in at least one further component (112, 114, 116) of said components of said upper structure (110).

25. The pallet as claimed in claim 3, wherein a connection between each fourth component (10) and the central portion (24) of each first component (4) and/or the central portion (30) of each second component (6) is obtained in portions of ribs (12), provided in said fourth component (10) by partial removal of adjacent portions of the rib, and of corresponding second complementary apertures (46) formed in the rib (12) of the central portion (24) of said first component (4) and/of the central portion (30) of said second component (6).

26. The pallet as claimed in claim 2, wherein the outer lateral webs (16) of the basic profile (2') comprise a wall parallel to lateral walls (22) of said at least one rib (12), an edge securely connected to the top (17) of the rib (12), and an inclined intermediate band (54) connecting said parallel wall to said edge.

27. The pallet as claimed in claim 26, wherein said first component (60) comprises second slits (74) provided in the respective inclined intermediate bands (54) of the profile (2'), for insertion-engagement of second tabs (76) which extend from ends of the lateral portions (28) of the second components (62).

28. The pallet as claimed in claim 26, wherein, in the inclined intermediate bands (54) of the profile (2') which defines the central portion (24) of said first component (60), shaped third slits (86) are provided, intended to be insertion-engaged by corresponding vanes (92, 94) provided in a free edge of the lateral portions (36) of the third component (64).

29. The pallet as claimed in claim 2, wherein a connection between a free end of each lateral portion (36) of each third component (8) and the central portion (24) of each first component (4) is obtained by inserting a shaped portion of said free end between an outer lateral band (6) and the rib (12) of said central portion.

30. The pallet as claimed in claim 2, wherein a connection between the central portion (34) of each third component (8) and the central portion (30) of each second component (6), and between the central portion (34) of each third component (8) and the terminal portion (32) of each first component (4), is obtained in portions of ribs (12) provided in said central portion of said third component (8) by partial removal of adjacent portions of the rib, and in second complementary apertures (46) formed in the rib (12) of the central portion (30) of said second component (6) and of the terminal portion (32) of said first component (4).

31. The pallet as claimed claim 1, wherein the outer lateral webs (16) of the basic profile (2) comprise a wall parallel to lateral walls (22) of said at least one rib (12) and a 90° bent edge coplanar with the top (17) of said rib (12).

32. The pallet as claimed in claim 1, wherein a connection between a free end of the lateral portion (28) of each second component (6) and the central portion (24) of each first component (4) is obtained by engagement of said free end with a tab (47) provided in said central portion (30) and bent at 90° to a plane the central portion lies.

33. The pallet as claimed in claim 1, wherein a connection between a free end of each terminal portion (32) of each first component (4) and the central portion (30) of each second component (6) is obtained by engagement of at least one tab provided in said free end, in a corresponding aperture provided in proximity to each end of the central portion (30) of said second component (6).

34. The pallet as claimed in claim 1, wherein the basic profile (2) comprises two ribs (12) between which a central band (15) is interposed, coplanar with said base plane (14).

35. The pallet as claimed in claim 1, wherein said first component (60) also comprises two vertical terminal portions (68) which extend downwards from said upper portions (32).

36. The pallet as claimed in claim 1, wherein said first component (60) comprises first slits (70) provided in the top (17) of the ribs (12) of the profile (2) for engagement of first tabs (72), which extend from ends of the lateral portions (28) of the second components (62).

37. The pallet as claimed in claim 1, wherein said first component (60) comprises shaped projecting zones (78) configured to enter, and to engage in, a narrower portion of apertures defined in said second component (62).

* * * * *